US005595112A

United States Patent [19]

Seo

[11] Patent Number: 5,595,112

[45] Date of Patent: Jan. 21, 1997

[54] STAMP ASSEMBLY AND STAMP UNIT INCLUDING THE STAMP ASSEMBLY AND A PERFORATION DEVICE

[75] Inventor: Keiji Seo, Nagoya, Japan

[73] Assignee: Brother Kogyo Kabushiki Kaisha, Nagoya, Japan

[21] Appl. No.: 561,753

[22] Filed: Nov. 22, 1995

[30] Foreign Application Priority Data

Dec. 22, 1994 [JP] Japan ..... 6-319704

[51] Int. Cl.[6] ..... B41F 1/04

[52] U.S. Cl. ..... 101/26; 101/125; 101/126; 101/479; 101/333

[58] Field of Search ..... 101/125, 126, 101/26, 27, 31, 479, 48, 4, 327, 333, 121, 127.1, 405

[56] References Cited

U.S. PATENT DOCUMENTS

| | | | |
|---|---|---|---|
| 681,121 | 8/1907 | Hudson | 101/26 |
| 1,285,837 | 11/1918 | Swanson | 101/26 |
| 2,667,119 | 1/1954 | Thomas | 101/125 |
| 5,184,549 | 2/1993 | Imamaki et al. | 101/125 |
| 5,253,581 | 10/1993 | Miki et al. | 101/125 |
| 5,285,725 | 2/1994 | Imamaki et al. | 101/127.1 |
| 5,483,880 | 1/1996 | Seo et al. | 101/125 |

FOREIGN PATENT DOCUMENTS

| | | |
|---|---|---|
| 0553999A1 | 8/1993 | European Pat. Off. . |
| U-5-74833 | 10/1993 | Japan . |

*Primary Examiner*—Eugene H. Eickholt
*Attorney, Agent, or Firm*—Oliff & Berridge

[57] ABSTRACT

A guide hole 18 is formed in a left side wall 17 of a grip 2 provided to a stamp assembly 1. When the stamp assembly 1 is mounted to a thermal perforation unit 50, a guide bar 38 provided to the thermal perforation unit 50 is inserted into the guide hole 18. A protector clasp 18*a* for opening and closing the guide hole 18 is provided to the left side wall 17. The protector clasp 18*a* can be manually slid up and down in a protector clasp groove 17*a*. When the protector clasp 18*a* is in a lower position shown in FIG. 1 (*a*), the guide hole 18 is closed so that the stamp assembly 1 can not be mounted to the thermal perforation unit 50. When the protector clasp 18*a* is in an upper position shown in FIG. 1 (*b*), the guide hole 18 is closed so that the stamp assembly 1 can be mounted to the-thermal perforation unit 50.

14 Claims, 23 Drawing Sheets

STAMP ASSEMBLY AND STAMP UNIT INCLUDING THE STAMP ASSEMBLY AND A PERFORATION DEVICE

BACKGROUND OF THE INVENTION

1. Field of the Invention

The present invention relates to a stamp assembly and to a stamp unit including the stamp assembly and a thermal perforation device. The stamp assembly has a print face of heat-sensitive stencil paper in which the thermal perforation device forms perforations.

2. Description of the Related Art

Conventionally, various kinds of stamps having a print face formed of rubber have been used to print company names, addresses, or other character trains on a paper surface. These types of stamps are individually made to order and so are expensive and a user must wait for a long time to receive the stamp after ordering.

There has been known a method of using infrared radiation or a thermal head to perforate a predetermined pattern in a heat-sensitive stencil paper. Character trains, diagrams, marks, and the like corresponding to the predetermined pattern can be printed by transmitting ink through this group of perforations and onto an object to be printed with the pattern.

Japanese Utility Model Application (KOKAI) No. HEI-5-74833 describes an ink stencil print plate for use instead of stamps having a print face formed from rubber. The ink stencil print plate includes basically an ink-impregnated member impregnated with ink; a frame framing the ink-impregnated member; a synthetic resin film adhered to one surface of the ink-impregnated member and the frame; and a heat-sensitive stencil paper adhered to the other side of the ink-impregnated member and the frame. A detachable film separator is disposed between the ink-impregnated member and the heat-sensitive stencil plate.

The stencil print plate is adhesively attached, via a cushion member, to the lower surface of a grip. Infrared irradiation or a thermal head is used to perforate the heat-sensitive stencil paper with a dot pattern having a desired pattern, such as a character train. A stamp having the grip and the heat-sensitive stencil plate is thus produced. As with a normal rubber stamp, the desired pattern, such as a character train, can be printed on a sheet many times. Hereafter this stamp employing a stencil print plate will be referred to as a stamp assembly.

The desired pattern, such as a character train, is perforated in the heat-sensitive stencil paper of the heat-sensitive stencil plate using a thermal perforation device including a thermal head and a guide bar. The grip of the stamp assembly is formed with a guide hole through which guide bar is inserted to mount the stamp assembly to the thermal perforation device.

SUMMARY OF THE INVENTION

However, the guide holes are always open so that even a stamp assembly which has already undergone perforation operations can be mounted to the thermal perforation device. This results in the danger of an operator mistakenly mounting the stamp assembly to the thermal perforation device and re-perforating the stencil paper of the stamp assembly. When the stencil paper is perforated twice, not only is the first perforation pattern rendered unusable, but also ink leaks from the perforation portion, thereby dirtying the thermal head.

It is an objective of the present invention to overcome the above-described problems and to provide a stamp assembly and a stamp unit which can reliably prevent double perforation on the stamp assembly.

To achieve the above-describe objectives, a stamp assembly according to the present invention includes a mounting member reception portion formed with a guide hole through which a guide bar of a thermal perforation unit is inserted to mount the stamp assembly to the thermal perforation unit; a stencil plate fixed to said mounting member reception portion, said stencil plate including an ink-impregnated member and a heat-sensitive stencil sheet; and an opening-closing lid for opening and closing the guide hole.

A stamp unit according to the present invention includes a stamp assembly having a mounting member reception portion formed with a guide hole; a stencil plate fixed to said stamp assembly, said stencil plate including an ink-impregnated member and a heat-sensitive stencil sheet; a thermal perforation unit for forming perforations in the heat-sensitive stencil sheet; a guide bar for passing through the guide hole to position said stamp assembly at a position where said thermal perforation unit can form perforations in the heat-sensitive stencil sheet; and an opening-closing lid for opening and closing the guide hole.

BRIEF DESCRIPTION OF THE DRAWINGS

The above and other objects, features and advantages of the invention will become more apparent from reading the following description of the preferred embodiment taken in connection with the accompanying drawings in which:

FIG. 5 (*b*) is a planar view showing a side of the protector clasp that faces the stamp assembly;

FIG. 5 (*c*) is a cross-sectional view showing the protector clasp inserted in the protector clasp groove as viewed from inside the stamp assembly;

FIG. 6 (*b*) is a cross-sectional side view showing the guide hole in the open position;

DETAILED DESCRIPTION OF THE PREFERRED EMBODIMENTS

Figure 1A:
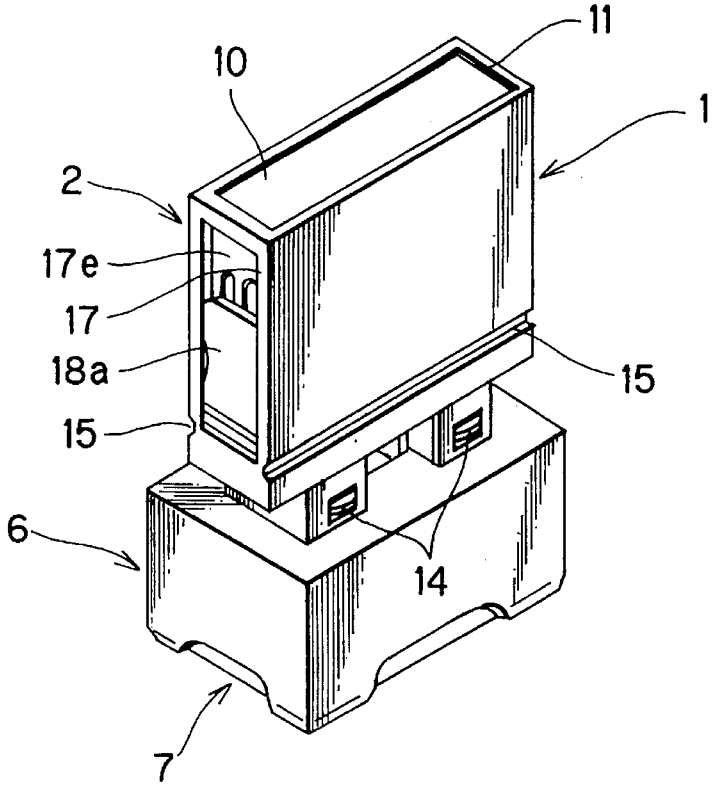
FIGS. 1 (*a*) and 1 (*b*) are perspective views showing a stamp assembly of a stamp unit according an embodiment of the present invention, wherein FIG. 1 (*a*) shows a protector clasp of the stamp assembly in a closed position and FIG. 1 (*b*) shows the protector clasp in an open position.

A stamp assembly and a stamp unit according to a preferred embodiment of the present invention will be described while referring to the accompanying drawings wherein like parts and components are designated by the same reference numerals to avoid duplicating description.

The stamp unit according to the present embodiment includes the stamp assembly 1 shown in FIGS. 1 to 11 and the thermal perforation device 50 shown from FIGS. 13 to 25. Unless otherwise mentioned, expressions such as left, right, up, down, rear, and back will be used in the following description to define the relative position of various parts when the stamp unit is disposed in an orientation in which it is intended to be used.

Figure 1B:
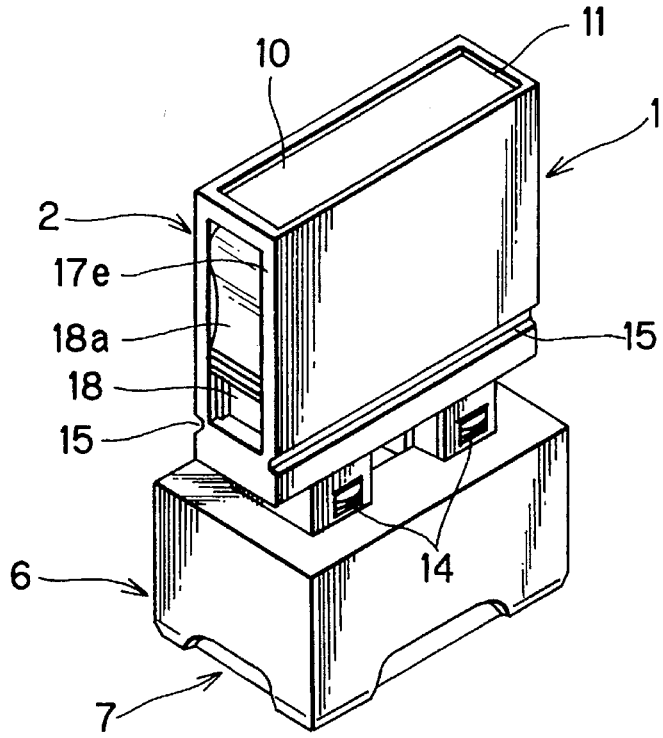

First, the stamp assembly 1 will be explained with reference to FIGS. 1 (*a*) to 11. As shown in FIGS. 1 (*a*), 1 (*b*), and 2, the stamp assembly 1 comprises a grip 2 for manual handling, a stamp member 3 attached to the grip 2, a skirt member 6 which is disposed between the grip 2 and the stamp member to run round the outer periphery of stamp member 3, and a protection cap 7 freely detachable from stamp member 3.

The grip 2 includes a rectangular hollow body having a top wall 19, a front wall 12, a rear wall 13, a left wall 17, and an opening, which faces downward. The hollow body is constructed from a metal or from a synthetic film material. A concave portion 11 to which a label 10 can be adhered is formed on the top to the grip 2. A spring support 20 is connected at the center of the inside surface of the top wall 19. A guide groove 15 is formed at lower portions of both the front wall 12 and the rear wall 13. A guide hole 18 and a protector clasp groove 17*a* are formed in the left-side wall 17. A pair of downward-projecting engaging pawls 14 is connected to the lower ends of both the front wall 12 and the rear wall 13.

A protector clasp 18*a* for opening and closing the guide hole 18 is engaged in the protector clasp groove 17*a*. The protector clasp 18*a* can be manually shifted up and down within protector clasp groove 17*a*. The guide hole 18 can be closed by shifting protector clasp 18*a* downward into a closed position and opened by shifting protector clasp 18*a* upward into an open position.

Figure 5A:
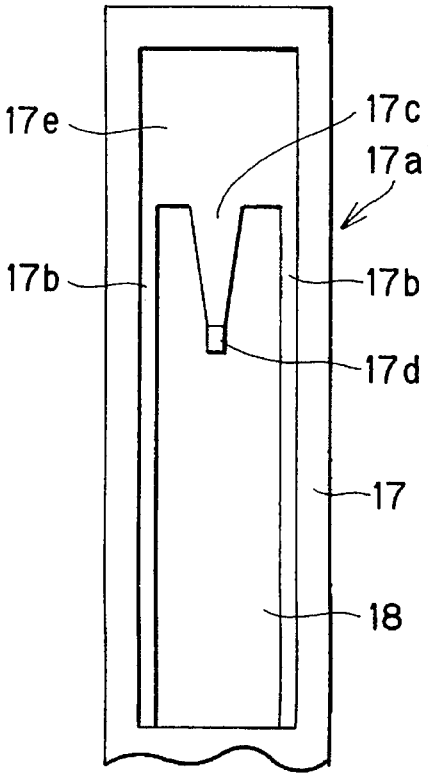
FIG. 5 (*a*) is a planar view showing a protector clasp groove of the stamp assembly into which the protector clasp is inserted.
Figure 5B:
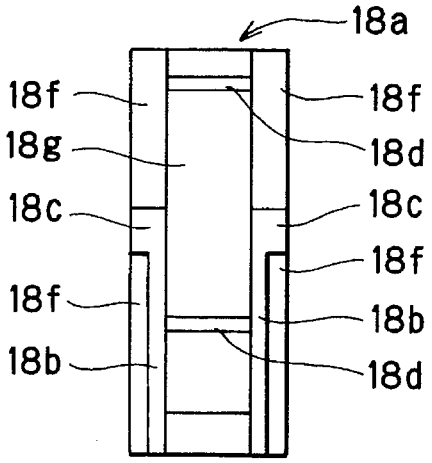
Figure 5C:
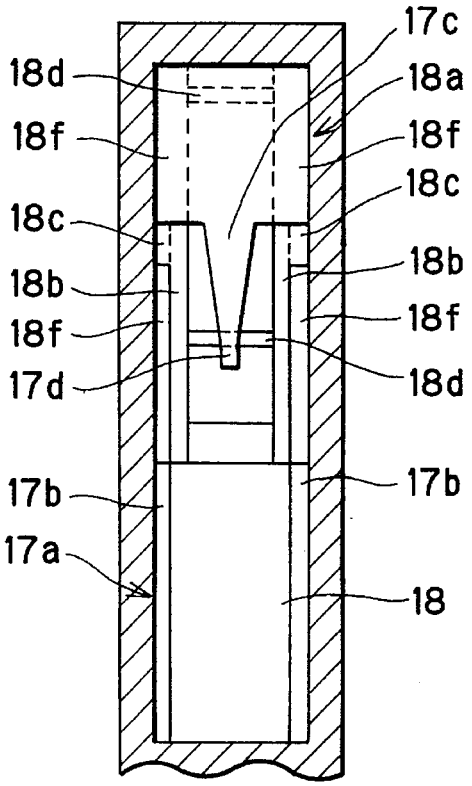

Next, the protector clasp groove 17*a* and the protector clasp 18*a* will be described in detail. As shown in FIG. 5 (*a*), the protector clasp groove 17*a* is framed by the left wall 17. A groove plate 17*e* including a pair of guide walls 17*b* and a resilient engagement slat 17*c* is provided in the protector clasp groove 17*a*. The pair of guide walls 17*b* extend in parallel on either side of the guide hole 18. The engagement slat 17*c* extends downward into guide hole 18 and between the guide walls 17*b*. The resilient engagement slat 17*c* tapers into an outwardly protruding tip 17*d*.

Figure 6A:
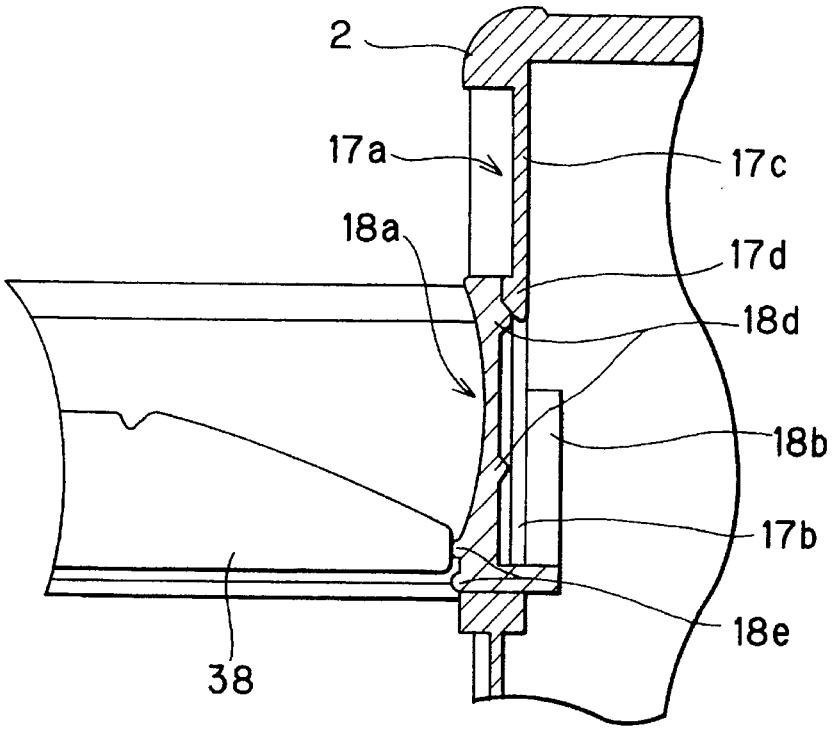
FIG. 6 (*a*) is a cross-sectional side view showing the guide hole in the closed position.
Figure 6B:
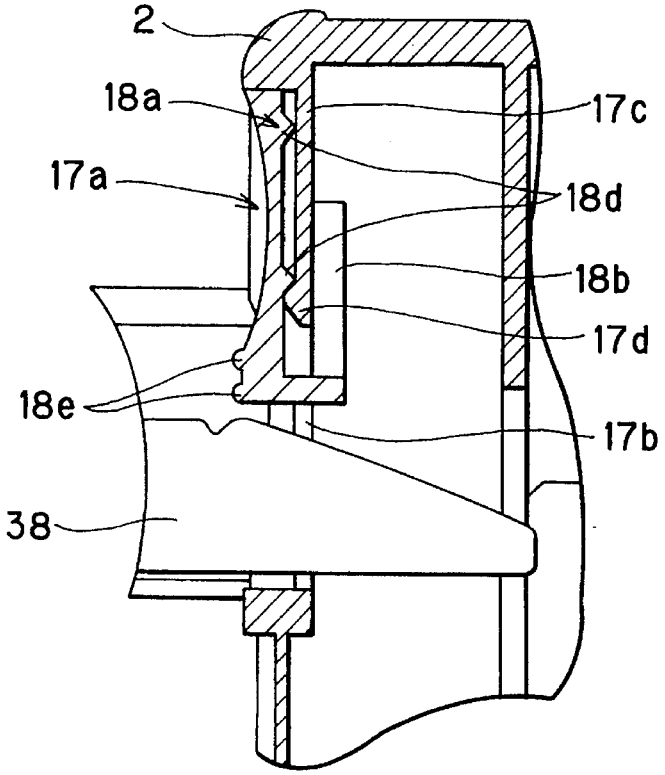

Next, the construction of the protector clasp 18*a* will be explained while referring to FIG. 5 (*b*). A pair of parallel walls 18*f* defining a groove 18*g* therebetween extend along the rear surface of the protector clasp 18*a* in a direction in which the protector clasp 18*a* slides within the protector clasp groove 17*a*. One of a pair of elastic engagement slats 18*b* having inner edges aligned with inner walls of a respective parallel wall 18*f* is provided to each of the parallel walls 18*f*. The elastic engagement slats 18*b* extend in parallel with the parallel walls 18*f* from a lower edge of the protector clasp 18*a* to near its center, where they then bend to extend outwardly to form projectors 18*c*. It should be noted that the elastic engagement slats 18*b* are formed to bend elastically within a predetermined range. Upper and lower ridges 18*d* are formed in parallel with each other at a predetermined interval at the surface between the parallel walls 18*f* so as to extend in a direction perpendicular to the direction in which the protector clasp 18*a* slides within the protector clasp groove 17*a*. As shown in FIGS. 6 (*a*) and 6 (*b*), the front surface of the protector clasp 18*a* is curved to match the shape of an operator's finger. Ridges 18*e* are formed at the lower edge of the protector clasp 18*a* to prevent the operator's finger from slipping while he or she is operating the protector clasp 18*a*.

FIG. 5 (*c*) shows the protector clasp 18*a* engaged in the protector clasp groove 17*a*. When the protector clasp 18*a* is pressed into the protector clasp groove 17*a*, the pair of elastic engagement slats 18*b* press against outer surfaces of the guide walls 17*b*. When further pressure is applied to the protector clasp 18*a*, the engagement slats 18*b* deform toward each other, pass around the guide walls 17*b*, and regain their original shape so as to engage with an inner wall of the guide walls 17*b*. As a result, the guide walls 17*b* are sandwiched between corresponding engagement slats 18*b* and projectors 18*c* on one side and the corresponding parallel walls 18*f* on the other so that the protector clasp 18*a* can be slid up and down within the protector clasp groove 17*a*.

As shown in FIG. 6 (*a*), when the protector clasp 18*a* is in the closed position, the upper surface of the projector 18*d* engages the lower surface of the tip 17*d* of the engagement slat 17*c*. This allows the protector clasp 18*a* to securely maintain the guide hole 18 closed. Then as shown in FIG. 6 (*b*), when the protector clasp 18*a* is in the open position, the lower surface of the lower projector 18*d* engages the lower surface of the tip 17*d* of engagement slat 17*c*. This allows the protector clasp 18*a* to securely maintain the guide hole 18 open.

Because the elastic engagement slats 18*b* of the protector clasp 18*a* are constructed so as to bend elastically within a predetermined range, the elastic engagement slats 18*b* can deform to pass around guide wall 17*b* and through the protector clasp groove 17*a* when the protector clasp 18*a* is pushed into the protector clasp groove 17*a*. This facilitates mounting of the protector clasp 18*a* into the protector clasp groove 17*a*.

Figure 2:
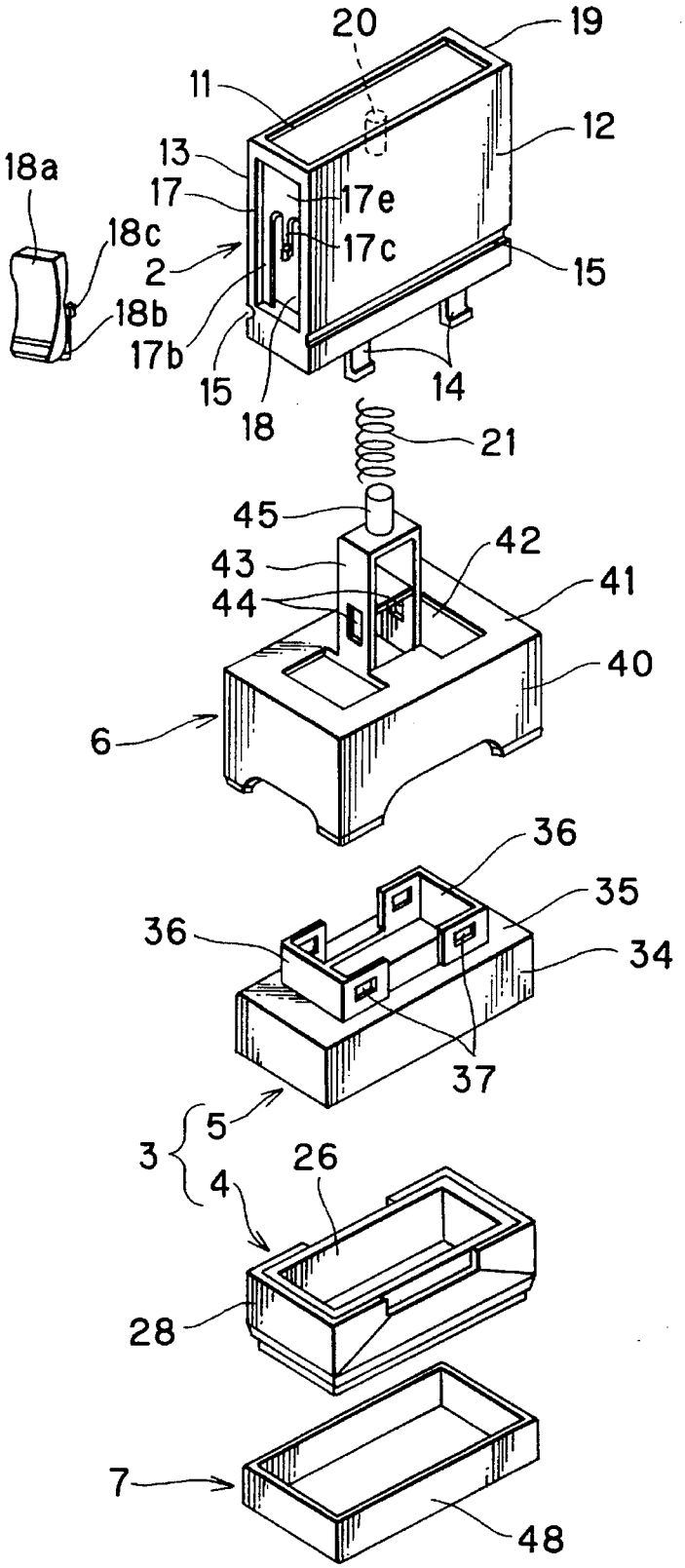
FIG. 2 is an exploded perspective view showing components of the stamp assembly.
Figure 7:
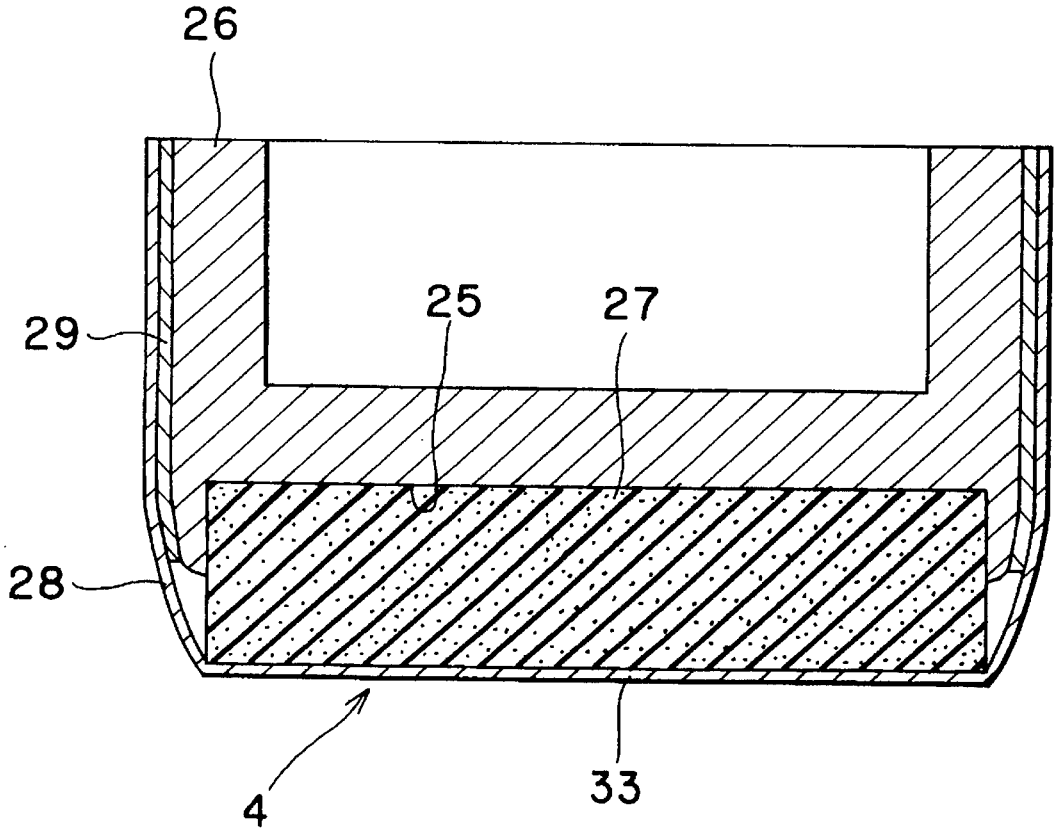
FIG. 7 is an enlarged cross-sectional front view of a stamp member of the stamp assembly.

Next, the construction of the stamp member 3 will be explained. As shown in FIG. 2, the stamp member 3 includes a stamp frame 4 and an outer securing member 5. As shown in FIG. 7, the stamp frame 4 includes a base member 26, an impregnated member 27, and a heat-sensitive stencil paper 28. The base member 26 has a rectangular hollow body constructed from a metal or from a synthetic film material. A shallow concave recess 25 is formed in the lower face side of the base member 26. The impregnated member 27, which is impregnated with an oil-based ink, is mounted in the concave recess 25 of this base member 26. The heat-sensitive stencil paper 28 is adhesively attached to the outer peripheral surface of the base member 26 by an adhesive agent 29 covering the lower surface of the impregnated member 27 and the periphery of the base member 26. In addition, the impregnated member 27 can also be adhesively attached to the recess 25 of the base member 26 by use of adhesive agents and so on.

The base member 26 is formed from a synthetic resin having excellent oil-resistant properties or from a metal material because it is in direct contact with the oil-based ink. Examples of appropriate synthetic resins include vinyl chloride, polypropylene, polyethylene, polyacetal, and polyethylene terephthalate. By mounting the impregnated member 27 in the recess 25, positional deviation of the impregnated member 27 and leakage of the ink from the impregnated member 27 can be prevented.

The impregnated member 27 is formed of a synthetic resin sponge having elasticity or of a non-woven fabric. Examples of appropriate synthetic resins include vinyl chloride, polypropylene, polyethylene, polyethylene terephthalate, polyurethane, and acrylonitrile-butadiene rubber. Because, the impregnated member 27 is saturated with the oil-based ink, the ink will ooze from the impregnated member 27 when pressure is applied to the impregnated member 27.

Figure 8:
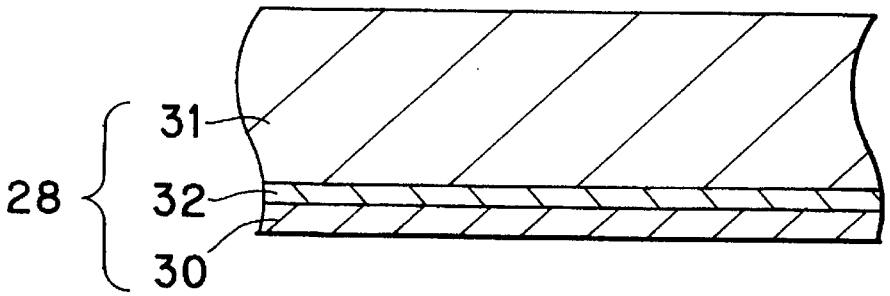
FIG. 8 is an enlarged cross-sectional view of a heat-sensitive stencil paper of the stamp member.

As shown in FIG. 8, the heat-sensitive stencil sheet 28 includes a thermoplastic film 30, a porous body 31, and an adhesive layer 32 which adheres the thermoplastic film 30 and the porous body 31 together. Films that are thinner than 1 μm are costly to produce and are also too weak for practical use. Films that are 4 μm or thicker cannot be perforated using a normal thermal head with an output rating of around 50 mJ/mm$^2$. Therefore, the thermoplastic film 30 is formed from a 1 to 4 μm thick or, more desirably, 2 μm thick film of a thermoplastic synthetic resin such as polyethylene terephthalate, polypropylene, or a copolymer of vinylidene chloride and vinyl chloride.

The porous support body 31 is made from porous thin sheets made mainly from natural fibers, such as manila hemp, paper mulberry (*Broussonetia kazinoki*), mitsumata (*Edgeworthia papyrifera*); synthetic fibers, such as polyethylene terephthalate, polyvinyl alcohol; or semi-synthetic fibers, such as rayon.

Figure 9:
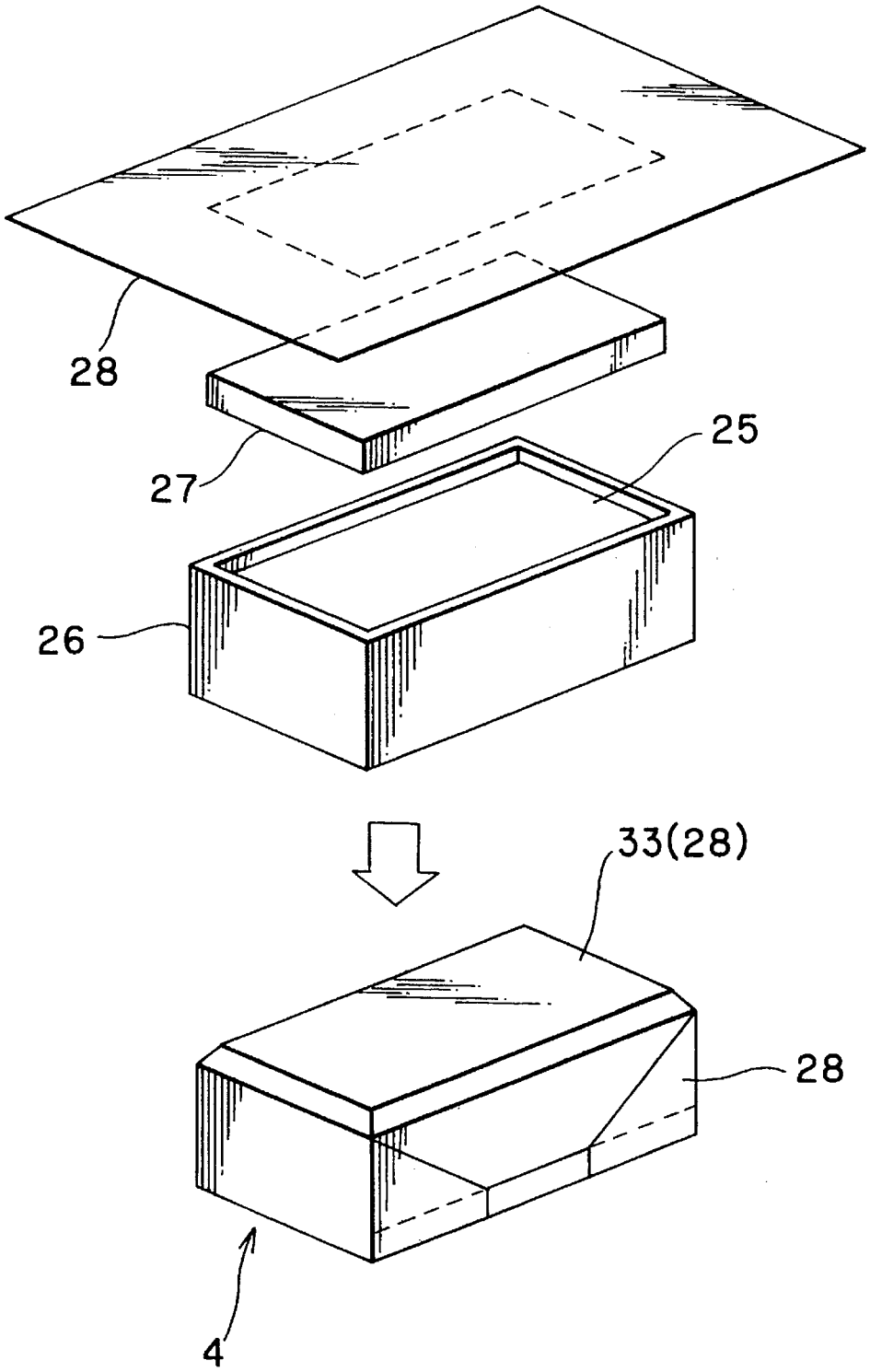
FIG. 9 is an exploded perspective view showing assembly of the stamp member.
Figure 10:
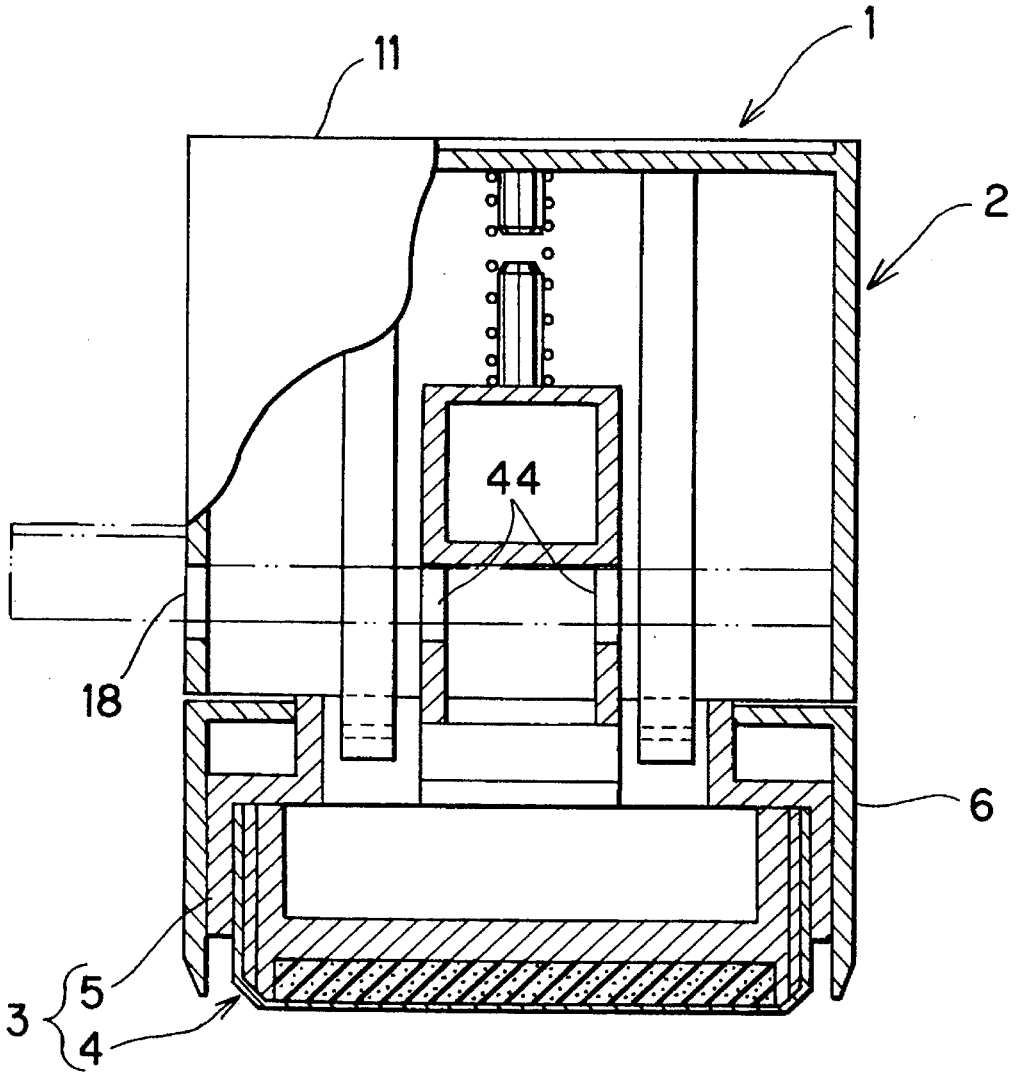
FIG. 10 is a cross-sectional front view showing a skirt member of the stamp assembly in a third position.
Figure 11:
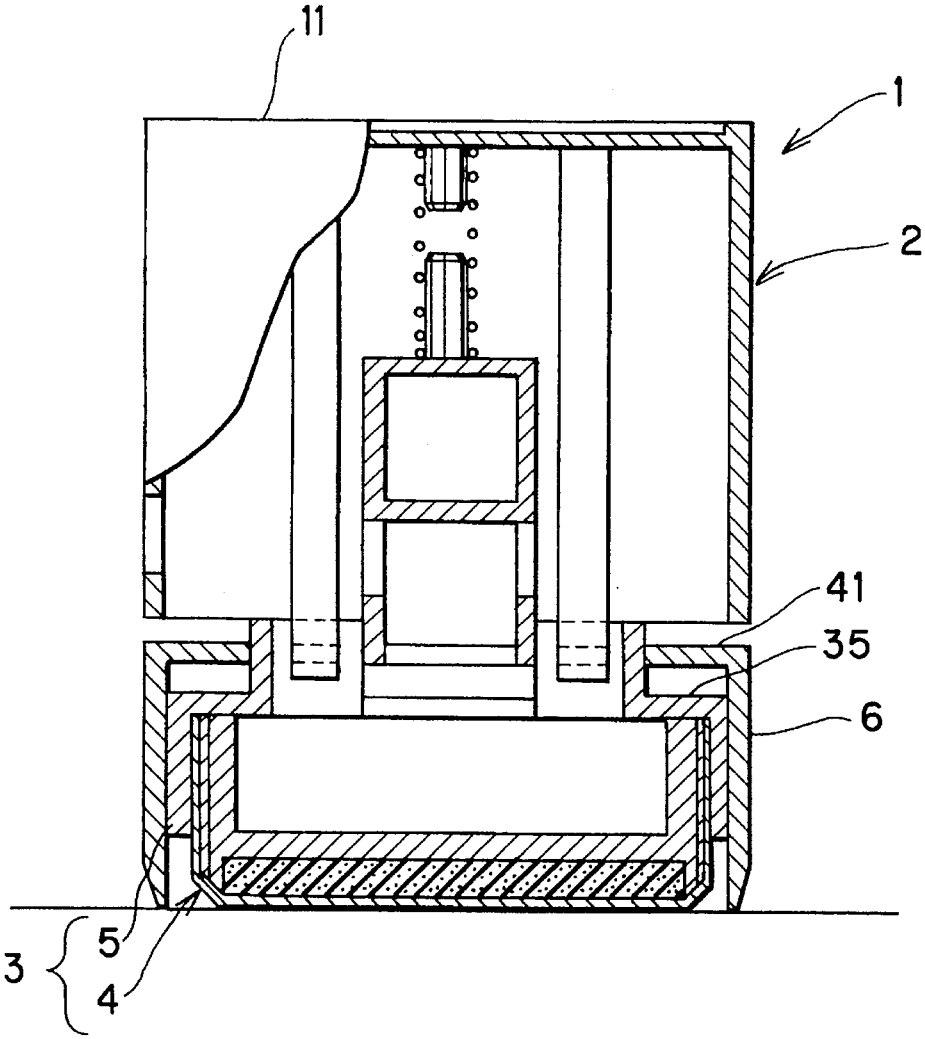
FIG. 11 is a cross-sectional front view showing the skirt member in a second position.

As shown in FIG. 9, to assemble the stamp frame the base member 26 is inverted and the impregnated member 27, which is impregnated with oil-based ink, is loaded into the concave recess 25. The heat-sensitive stencil paper 28 is placed over the impregnated member 27 so that, as shown in FIG. 7, the perforated support member 31 faces the impregnated member 27. The heat-sensitive stencil paper 28 is brought into intimate contact with the surface of the impregnated member 27. Then, the peripheral side of the heat-sensitive stencil paper is folded and attached with adhesive agent 29 to the peripheral surface of base member 26. The heat-sensitive stencil paper 28 affixed to the lower surface, as viewed in FIG. 7, of the impregnated member 27 serves as the print surface 33.

In order to affix the outer peripheral side of the heat-sensitive stencil paper 28 to the outer peripheral surface of the base member 26, a layer of the adhesive agent 29 can be precoated to the portion of the perforated support member 31 to be adhered. Alternatively, a layer of adhesive agent 29 can be precoated to the outer side surface of the base member 26. As a further alternative, the adhesive agent 29 can be precoated to both the perforated support member 31 of the heat-sensitive stencil paper 28 and to the outer side surface of the base member 26.

Figure 3:
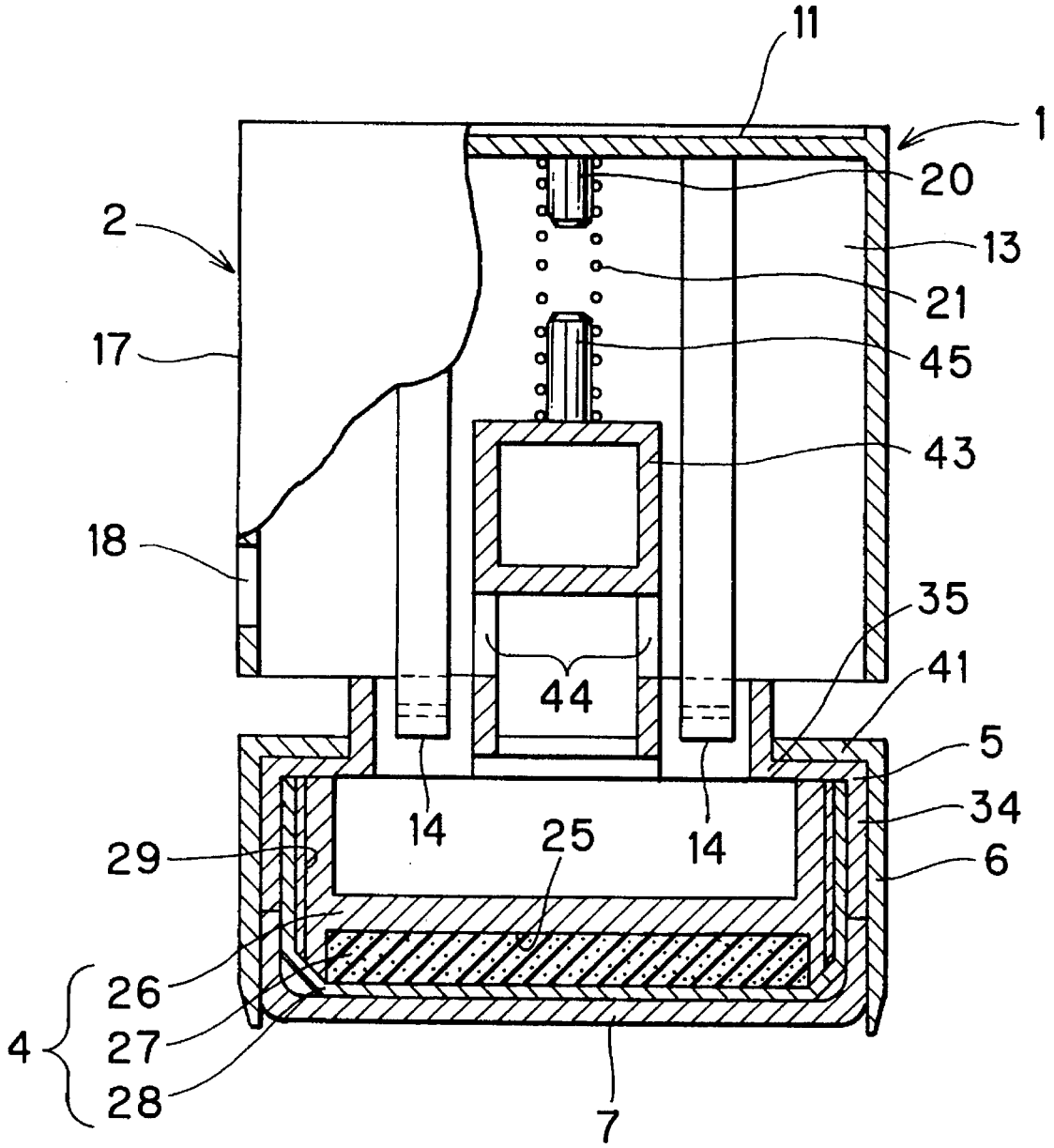
FIG. 3 is a cross-sectional view showing the stamp assembly from a front view.
Figure 4:
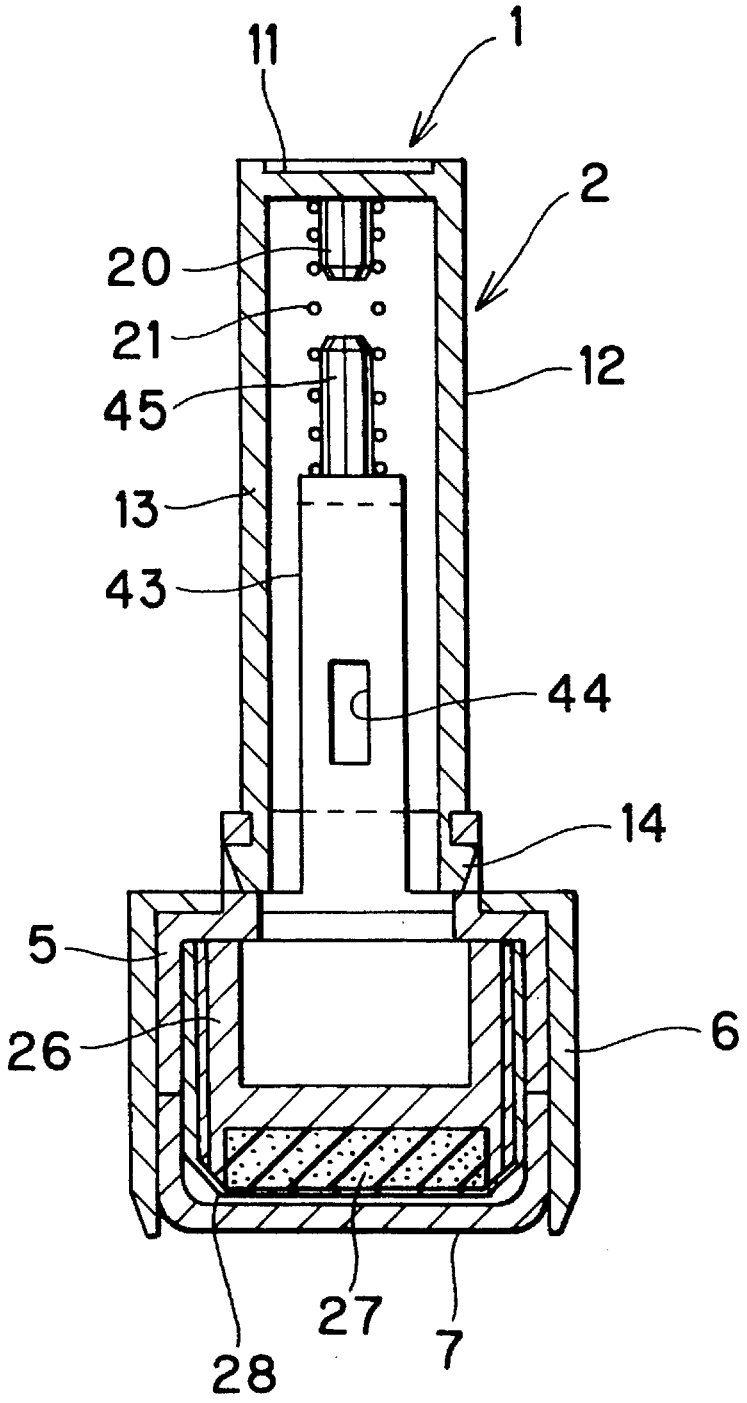
FIG. 4 is a cross-sectional view showing a stamp assembly from a side view.

As shown in FIGS. 2 to 4, the outer peripheral support member 5 includes the peripheral wall 34, wherein the stamp frame 4 is engaged; an upper wall 35; and a pair of engaging walls 36, each provided an opposite end on the upper wall 35. The peripheral wall 34 has a rectangular shape formed from four flat plates. The engaging walls 36 extend upward from the surface of the upper wall 35 to a predetermined height. Ends of each engaging wall 36 project inwardly toward corresponding end of the opposite engaging wall 36. Each inwardly projecting end is formed with an engaging hole 37 at a position that corresponds with one of the four engaging pawls 14 on the grip 2.

As shown in FIGS. 2 to 4, the skirt member 6 includes an outer peripheral wall 40; an upper wall 41; a doorway-shaped portion 43; and a spring support 45. The outer peripheral wall 40 has a rectangular shape formed from four flat plates. Elongated notches for attachment and detachment of the protection cap 7 and for determining the position of the print surface 33 are formed in the lower edges of the four flat plates of the outer peripheral wall 40. The doorway-shaped portion 43 extends upward from the center of the upper wall 41 to a predetermined height. A rectangular hole 42 is opened in the upper wall 41 on either side of the doorway-shaped portion 43. The spring support 45 protrudes from the center of the top of the doorway-shaped portion 43. Left and right guide holes 44 are formed in the left and right sides of the doorway-shaped portion 43 at positions corresponding with the guide hole 18. These guide holes 44 engage with the thermal perforation device 50 to be explained later.

Next, the assembly of the stamp assembly 1 will be described while referring to FIG. 2. First, the stamp frame 4 with the protection cap 7 attached thereto is inserted into the outer securing member 5 and fixed therein so that two-thirds of its upper periphery is covered by the outer securing member 5. The upper wall 41 of the skirt member 6 is positioned above the upper wall 35 of the outer peripheral hold member 5. Then, the outer peripheral wall 34 of the outer peripheral hold member 5 is inserted from below into the outer peripheral wall 40 so that the left and right engaging walls 36 pass through the pair of rectangular holes 42 of the skirt member 6. The fit of the outer peripheral wall 34 to the outer peripheral wall 40 allows the outer peripheral hold member to slide freely up and down in the skirt member 6. Finally, the four engaging pawls are engaged from above into corresponding engaging holes 37 on the engaging walls 36 so that the outer peripheral hold member 5 is fastened to the grip 2.

A compression spring 21 for urging the skirt member 6 downward is mounted between the spring support 20 on the grip 2 and the spring support 45 on the skirt member 6. This allows the skirt member 6 to freely ascend and descend from a first position shown in FIGS. 3 and 4, to a second position shown in FIG. 11, and further to a third position shown in FIG. 10. The downward urging of the spring 21 constantly urges the skirt member 6 into the first position. When in the first position, the upper wall 35 of the outer peripheral holding member 5 abuts the upper wall 41 of the skirt member 6 from the underside, and the lower side of the skirt member 6 projects lower than the print surface 33. When in the second position, the upper wall 41 of the skirt member 6 is positioned between the upper wall 35 of the upper peripheral holding member 5 and the lower side of the grip 2, and the lower side of the skirt member 6 is positioned at the same level as the print surface 33. When in the third position, the upper wall 41 of the skirt member 6 abuts the lower side of the grip 2, and the lower side of the skirt member 6 is positioned higher than the print surface 33. It is desirable to set the stroke from the first position to the second position of the skirt member 6 to approximately 5 mm.

The protection cap 7 is for covering and for protecting the stamp frame 4 and is detachably provided to the lower side of the stamp frame 4. The outer peripheral wall 48 of the protection cap 7 has the same rectangular shape as the outer peripheral wall 34 of the outer holding member 5. The outer peripheral wall 40 of the skirt member 6 supports therein the outer peripheral wall 48 of the protection cap 7.

As shown in FIGS. 3 and 4, when the protection cap 7 is fitted into the skirt member 6, its upper edges abut the lower edges of the outer peripheral wall 34, forming a small space between the protection cap 7 and the print surface 33. The protection cap 7 is supported by friction between the inner surface of the outer peripheral wall 40 of skirt member 6 and the outer surface of the outer peripheral wall 48. While the protection cap 7 is in the mounted condition, even if the grip 2 is forced downwards, the ink will not leak into the protection cap 7 because the space is preserved by abutment contact between the lower edges the outer peripheral wall 34 and the upper edges of the protection cap 7.

Next, the thermal print device 50 will be explained. As shown FIGS. 13 to 17, the thermal print device 50 includes a body frame 51, a keyboard 52, and a liquid crystal display 53 which are provided at the front of the body frame 51; a thermal perforation unit 54 provided in the rear interior of the body frame 51; and a control unit 110 provided on the inside of the body frame 51.

The keyboard 52 includes a plurality of character and symbol keys 56, various function keys, and a main switch 67. The character and symbol keys 56 include a plurality of character keys and symbol keys, which are used for both Japanese kana and the Roman alphabet. The function keys include a cursor shift key 57, an execution key 58, a line feed key 59, a determine/end key 60, a cancel key 61, a delete key 62, a shift key 63, a lower-case letter key 64, a letter-type setting key 65, and a perforation switch 66.

The liquid crystal display device 53 is designed to display several lines of character trains corresponding to a pattern to be printed by the stamp assembly 1.

Next, the thermal perforation portion 54 will be explained. As shown in FIGS. 15 to 23, the thermal perforation unit 54 includes a subframe 70; a perforation mount 71 housed in the subframe 70 and to which the stamp assembly 1 is freely mountable; and a thermal perforation mechanism 72 housed in the perforation mount 71 and which is for perforating dots into the print face 33 of the stamp assembly 1 mounted on the perforation mount 71.

The subframe includes a right side wall 73 and a left side wall 68; and a front wall 99 and a back wall (not shown in the drawings) extending between the right side wall 73 and the left side wall 68. An opening 74 is formed in the right side wall 73. The opening 74 is formed with substantially the same shape as a cross-section of the stamp assembly 1, wherein the greatest width of the opening 74 corresponds to the front to rear dimension of the stamp member 3. An opening-closing door 75, which opens and closes the opening 74, is securely affixed to a sector gear 76, which is rotatably disposed on the right side wall 72 via a pivot shaft 77.

The perforation mount 71 will be explained while referring to FIGS. 16 to 19. The perforation mount 71 is provided within subframe 70. Front and rear parallel guide members 78 and 79 extending between the right side wall 72 and the left side wall 69 are provided near the upper portion of the subframe 70. A guide 80 is provided to the lower end of each guide member 78 and 79. The guides 80 extend parallel with each other and protrude inward toward each other. A right and left roller 81, normally urged rearward by springs 82, are provided at the front side of the guide member 78 so as to be movable a short distance in and out of an elongated hole opened in the guide member 78.

Figure 18:
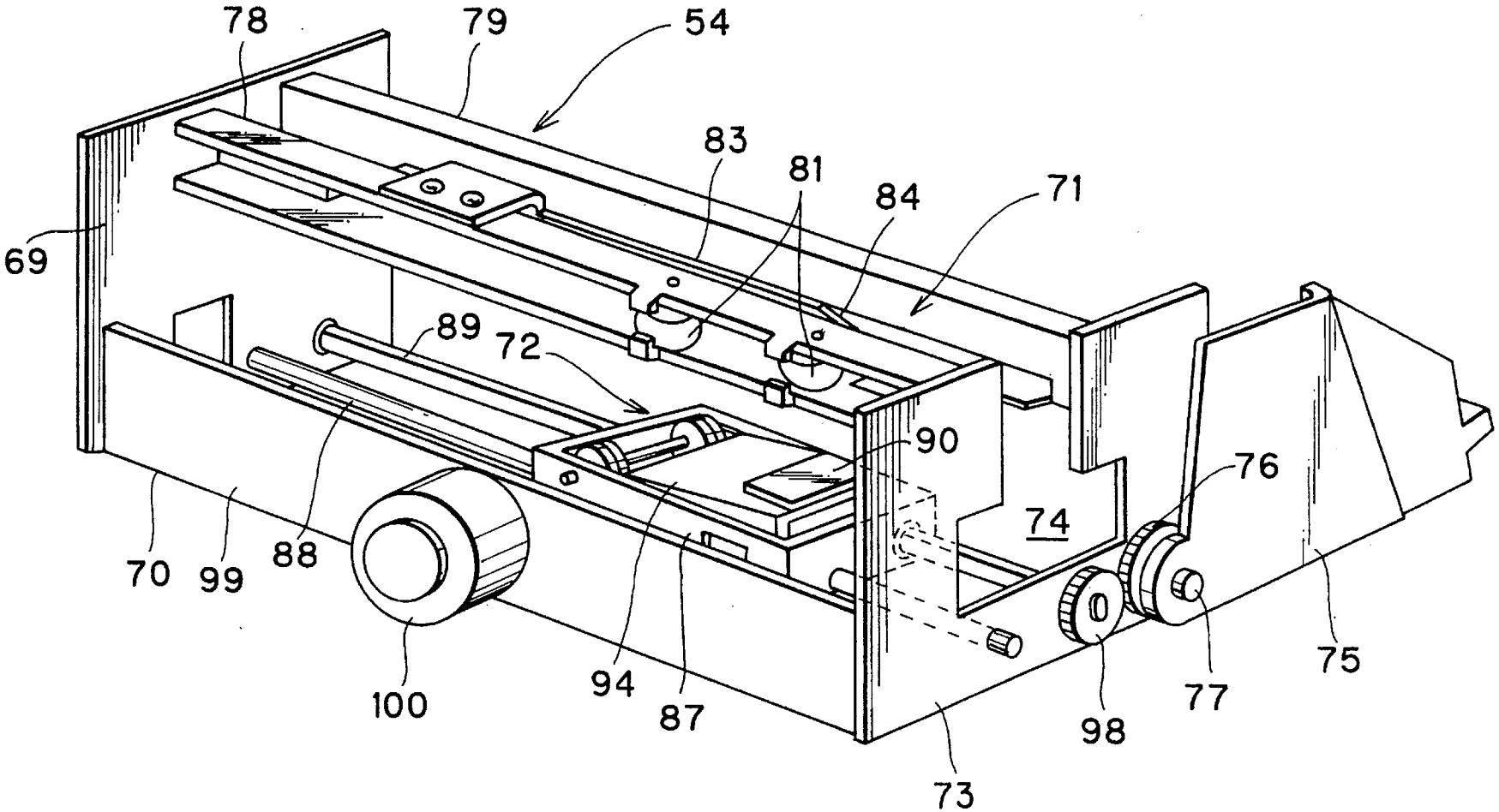
FIG. 18 is a perspective view showing a thermal perforation portion of the thermal perforation device.
Figure 19:
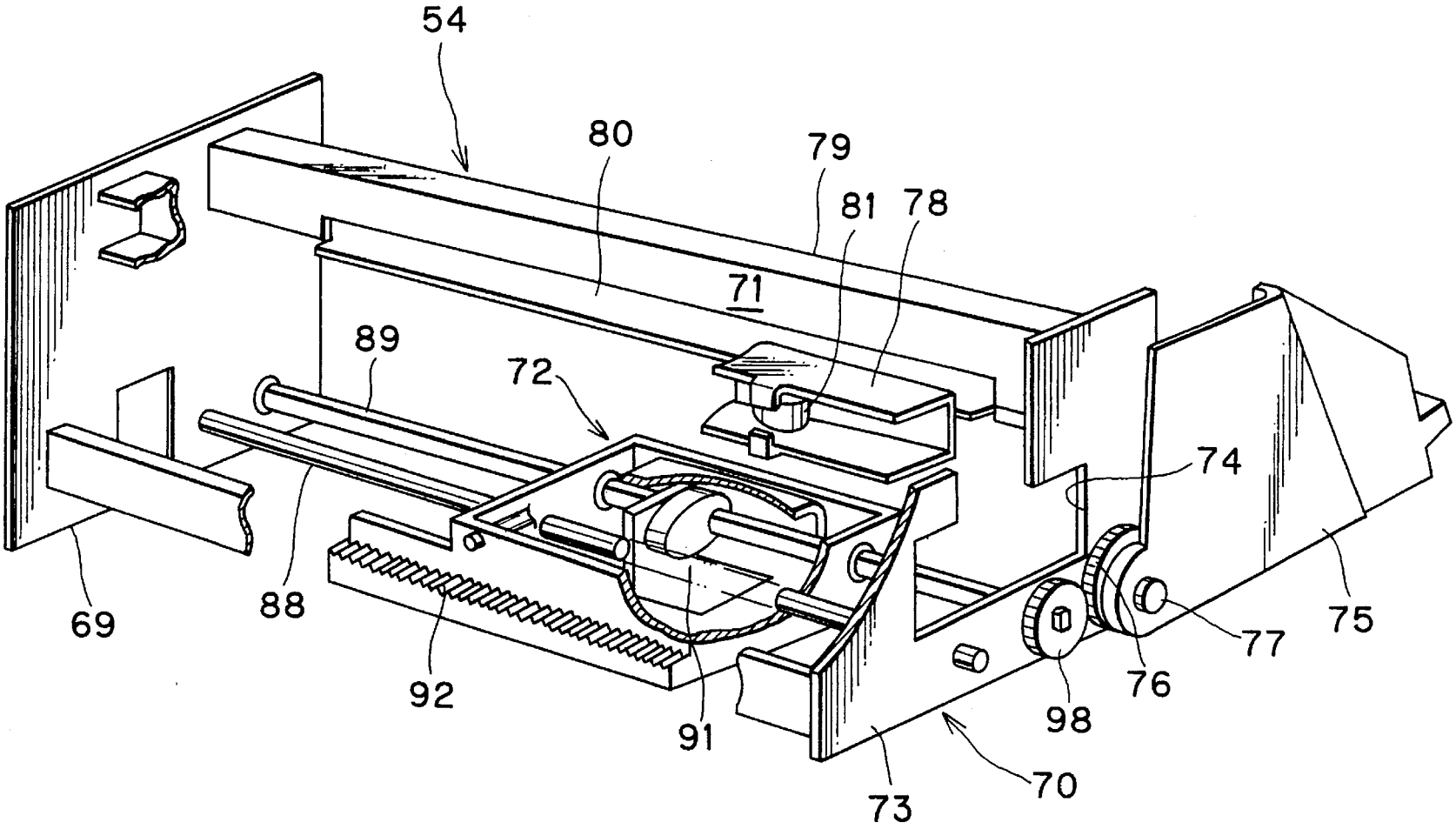
FIG. 19 is a perspective view showing essential portions of the thermal perforation portion with a section removed to facilitate explanation.
Figure 20:
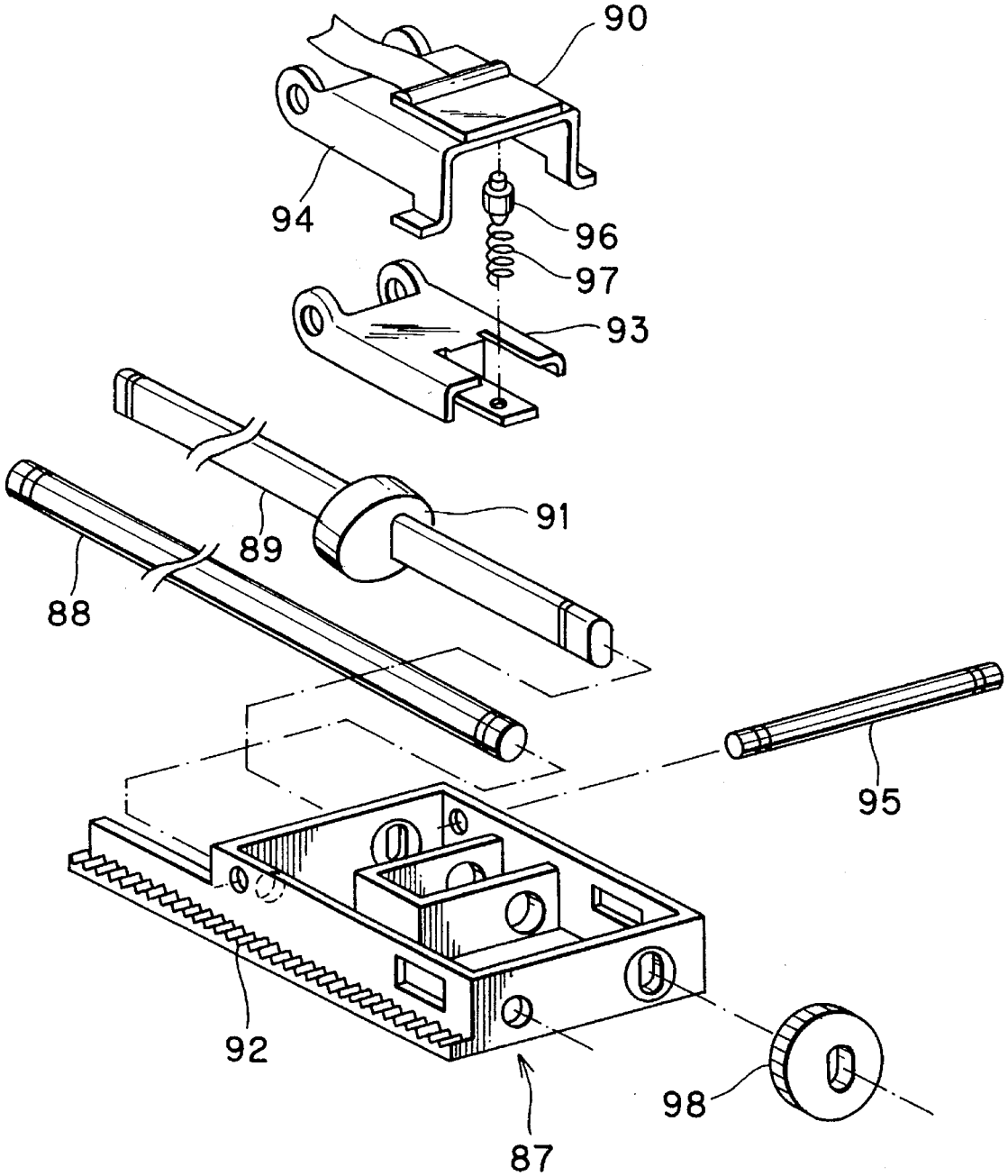
FIG. 20 is an exploded perspective view of the thermal perforation device.
Figure 22:
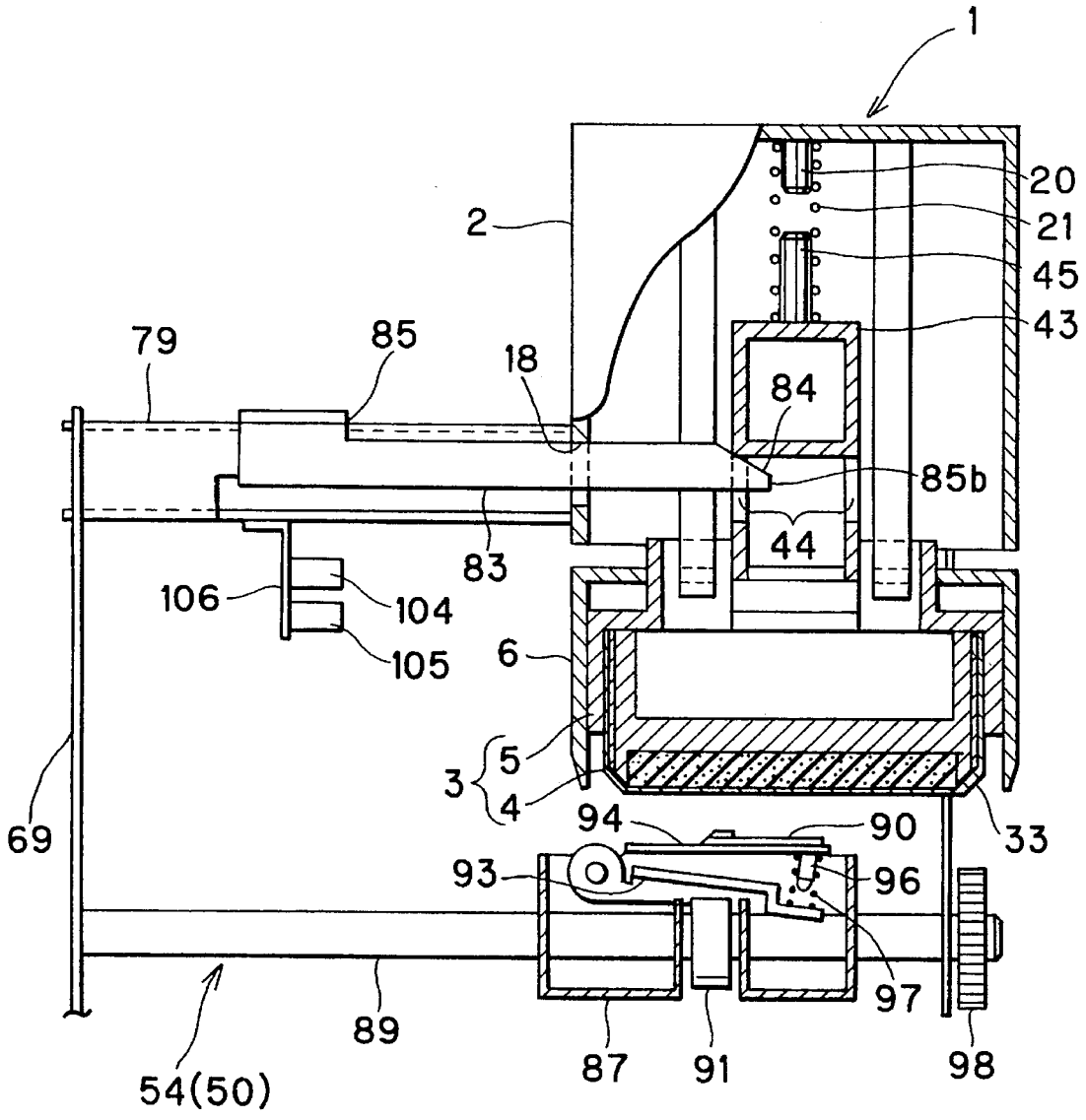
FIG. 22 is a cross-sectional front view showing the stamp assembly directly before mounting to the thermal perforation portion.
Figure 23:
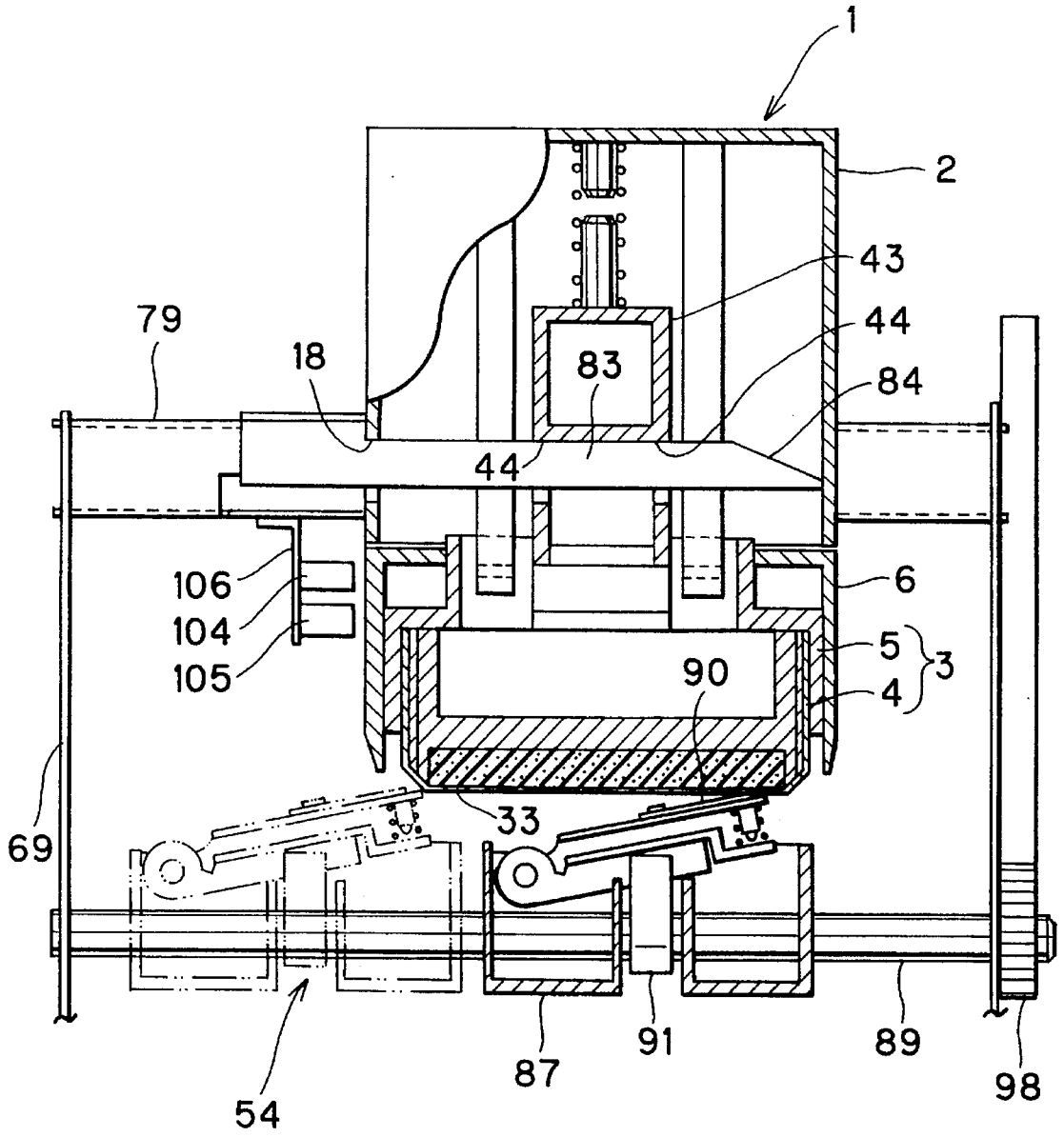
FIG. 23 is a cross-sectional front view showing the stamp assembly mounted to thermal perforation portion.

A guide bar 83, which is inserted into the guide holes 44 to guide the stamp assembly 1 toward the thermal perforation mechanism 72, is fixed to the guide member 78 so as to depend between the guide members 78 and 79. As shown in FIGS. 18, 22, and 23, a downward-slanting tapered face 84 is formed on the right end of the guide bar 83. A stop face 85 is formed on the guide bar 83 for stopping leftward movement of the stamp assembly 1, so that an inserted the stamp assembly will be positioned at the thermal perforation mechanism 72. When the stamp assembly 1 is correctly inserted into the thermal perforation device 50, an engaging portion **85*b* at the right end of guide bar 83 will abut the ridges 18*e* of the protector clasp groove 17*a* or will be inserted through the guide hole 18 of the grip 2**.

To perforate a dot pattern on the print face 33 of the stamp assembly 1, the stamp assembly 1 is inserted through the opening 74 of the thermal perforation device 50. The front and rear guides 80 of the thermal perforation unit 54 engage in the front and rear guide grooves 15 of the grip 2, whereby the stamp assembly 1 is supported by the pair of guides 80 and is urged rearward by the pair of rollers 81 and the springs 82 to be accurately positioned in the front and rear directions. Then, the guide bar 83 passes through the guide holes 44 provided at the doorway-shaped portion 43 of the stamp assembly 1, thus moving the skirt member 6 upwards and maintaining it in the third position shown in FIG. 10 throughout perforation.

Next, the thermal perforation mechanism 72 will be explained. As shown in FIGS. 15 to 23, a guide rod 88 and a head switch rod 89 extend between the right side wall 73 and the left side wall 69 of the subframe 70 so as to be in parallel with, but below, the guide members 78 and 79 of the perforation mount 71. A carriage 87 including a thermal head 90 is slidably mounted on the guide rod 88 and the head switching rod 89. A rack 92 is formed along the entire length and beyond the front side of the carriage 87.

An elliptically shaped cam member 91 is mounted on the head switching rod 89 so as to slide freely in the axial direction of the head switching rod 89 and so as to rotate with rotation of the head switching rod 89.

A cam contact plate 93 and a head heat-radiating plate 94 are mounted in the carriage 87 on a shaft 95, which extends perpendicular to the direction of movement of the carriage 87. The cam contact plate 93 and the head heat-radiating plate 94 can freely pivot in a vertical direction. The thermal head 90 is affixed to the head heat-radiating plate 94. The head heat-radiating plate 94 is elastically urged upwards relative to the cam contact plate 93 by a spring 97, which is wound around a pin 96 fixed to the head heat-radiating plate 94.

The cam member 91 is in abutment contact with the lower surface of the cam contact plate 93 so that rotation of the cam member 91 switches the position of the thermal head 90 mounted on the carriage 87. When the cam member 91 is oriented into a reclining posture by rotation of the head switching rod 89, the cam contact plate 93 will move downward so that the head heat-radiating plate 94 and the thermal head 90 also move downward. When the can member 91 is oriented into an upright posture, the cam contact plate 93 will swing upward so that the urging of the spring 97 will urge the thermal head 90 into the perforation position.

A gear 98 engaged with the sector gear 76 at the outside of the right side wall 73 is provided to the right end of the head switching rod 89. When the opening-closing door 75 is opened up, the cam member 91 will be oriented into the reclining posture. When the opening-closing door 75 is closed, the cam member 91 is switched to the upright posture.

On the front wall 99 of the subframe 70 are provided a stepping motor 100 for driving transport of the carriage 87; a driving gear 101 engaged with the rack 92; and a decelerating gear mechanism 107 for transmitting, to the driving fear 101, the rotation of an output gear 102 at the output shaft of the stepping motor 100. Therefore, the rotational driving output force of the stepping motor 100 is decelerated and transferred to the driving gear 101 so that the carriage 87 can be driven to the left and right direction by the stepping motor 100.

Figure 25:
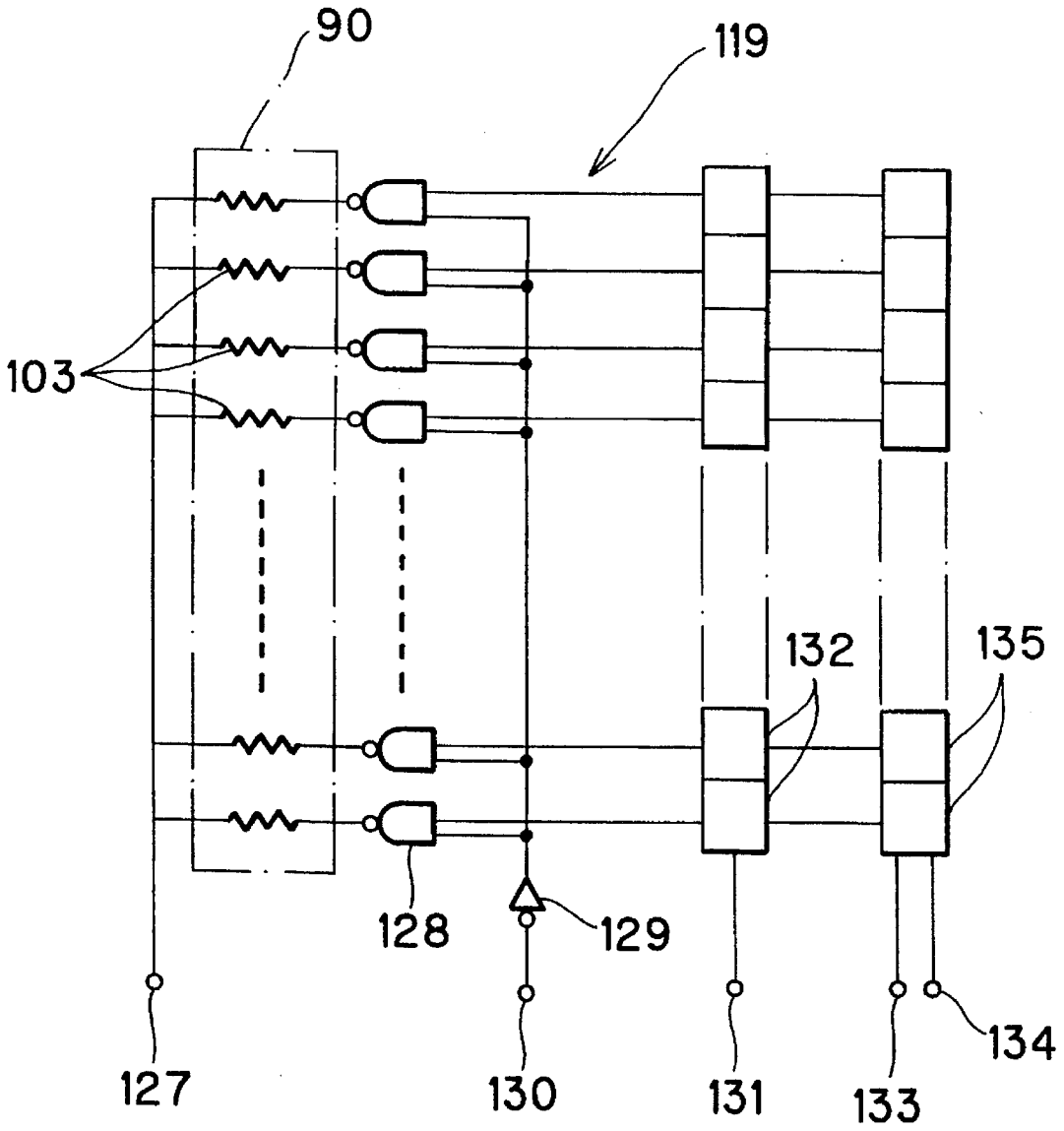
FIG. 25 is an electric circuit diagram showing a head drive circuit of the thermal perforation device.

The thermal head 90 is the same type as the thermal head of a thermal printer. The thermal head 90 is provided with 192 elements 103 aligned in a horizontal row as shown in FIG. 25.

Figure 24:
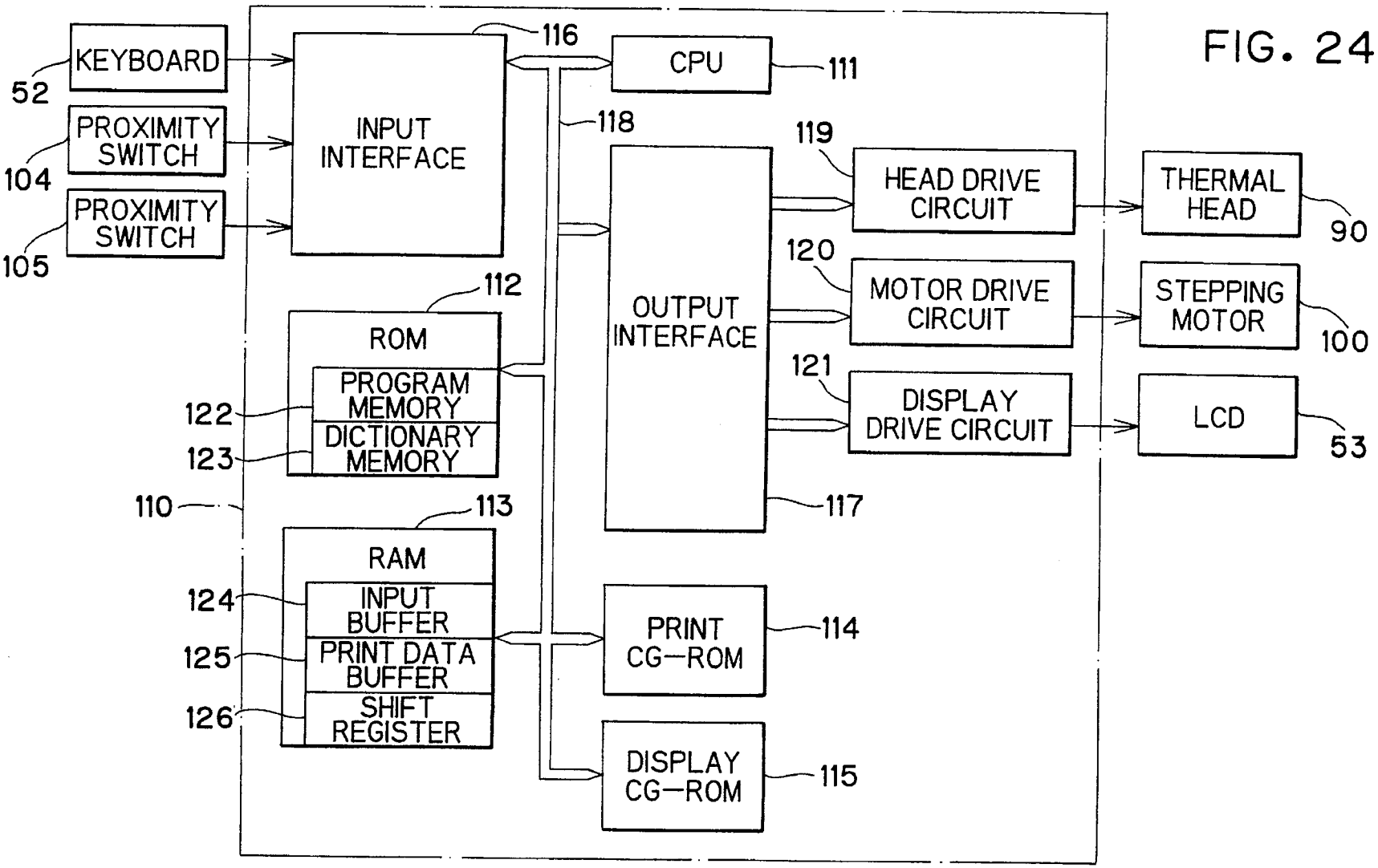
FIG. 24 is a block diagram showing a control system of the thermal perforation device.

Next, an explanation will be provided for a control system which includes a control unit 110, which controls drive of the heat perforation mechanism 72 and a liquid crystal display 53. As shown in FIG. 24, the control unit 110 is connected to the keyboard 52, the thermal head 90, the stepping motor 100, the liquid crystal display 53, and two proximity switches 104 and 105 which detect the presence of the stamp assembly 1 and its width in the front and rear direction.

Figure 15:
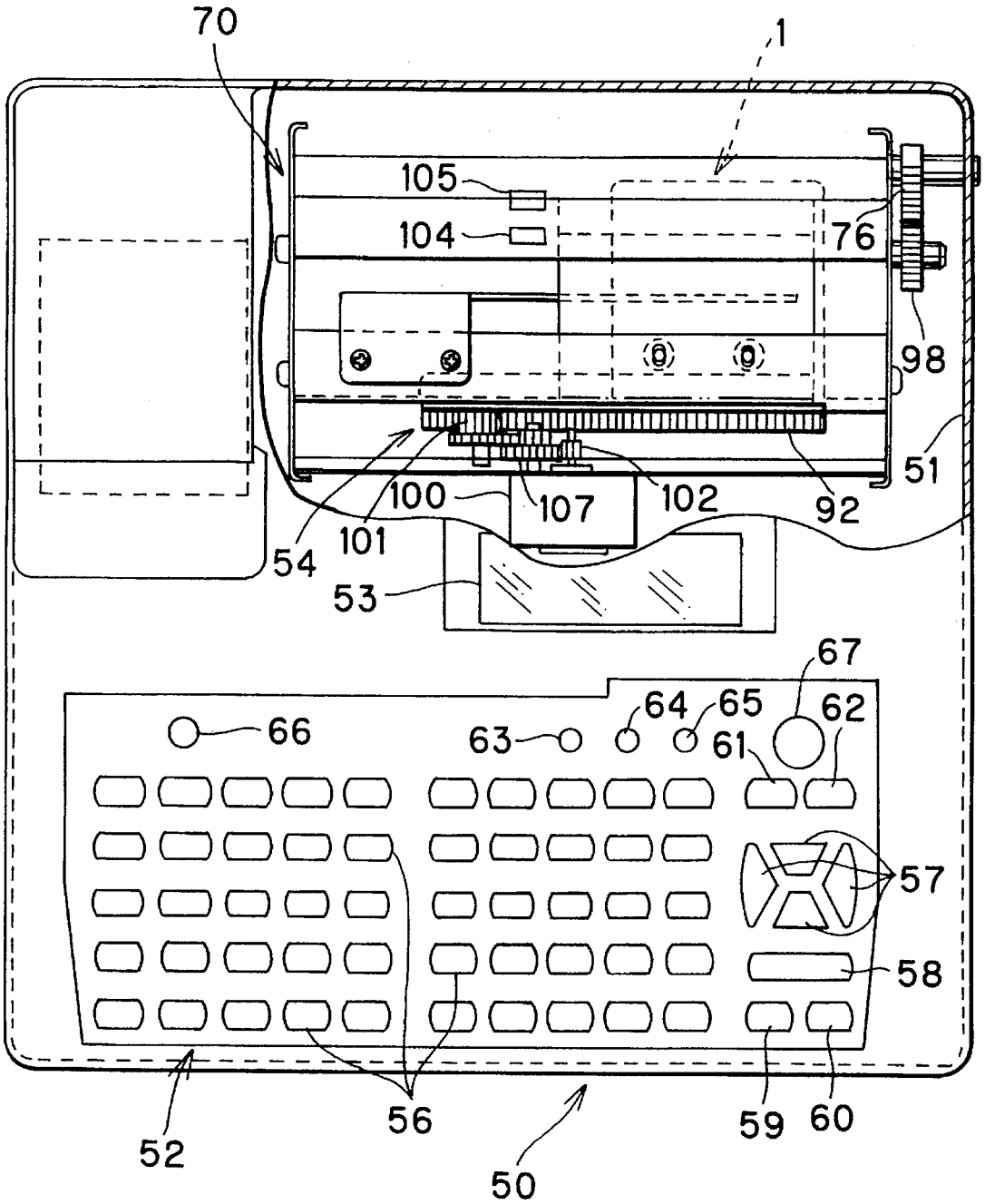
FIG. 15 is a bird's eye view of the thermal perforation device with a portion of a housing removed to facilitate explanation.
Figure 16:
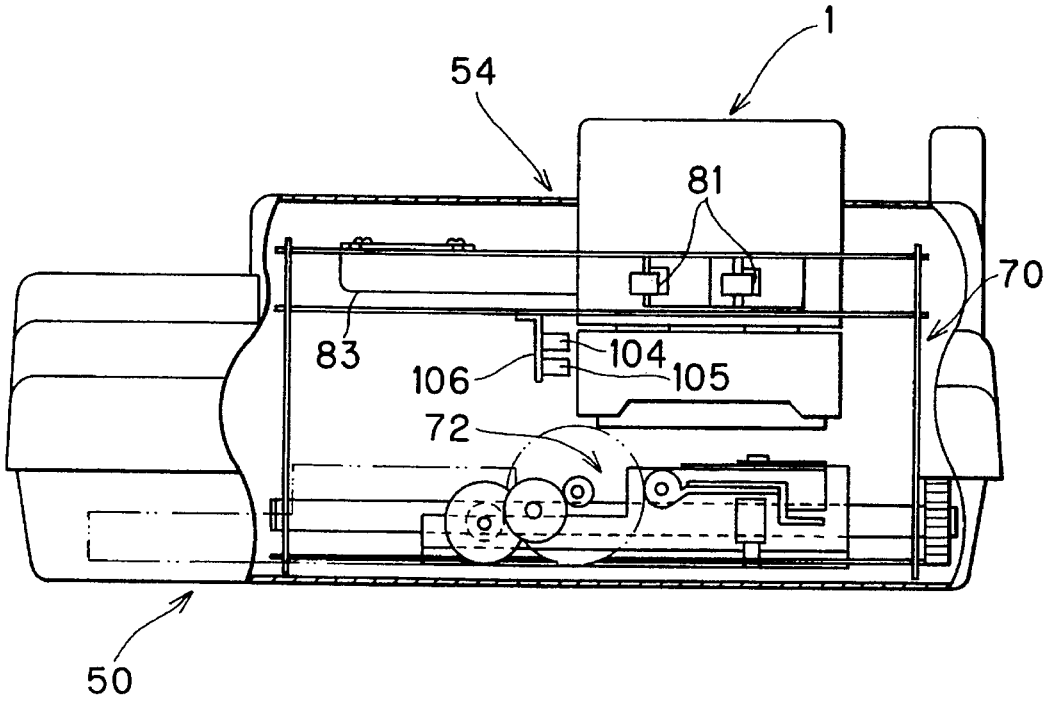
FIG. 16 is a frontal view of the thermal perforation device with a portion removed to facilitate explanation.
Figure 17:
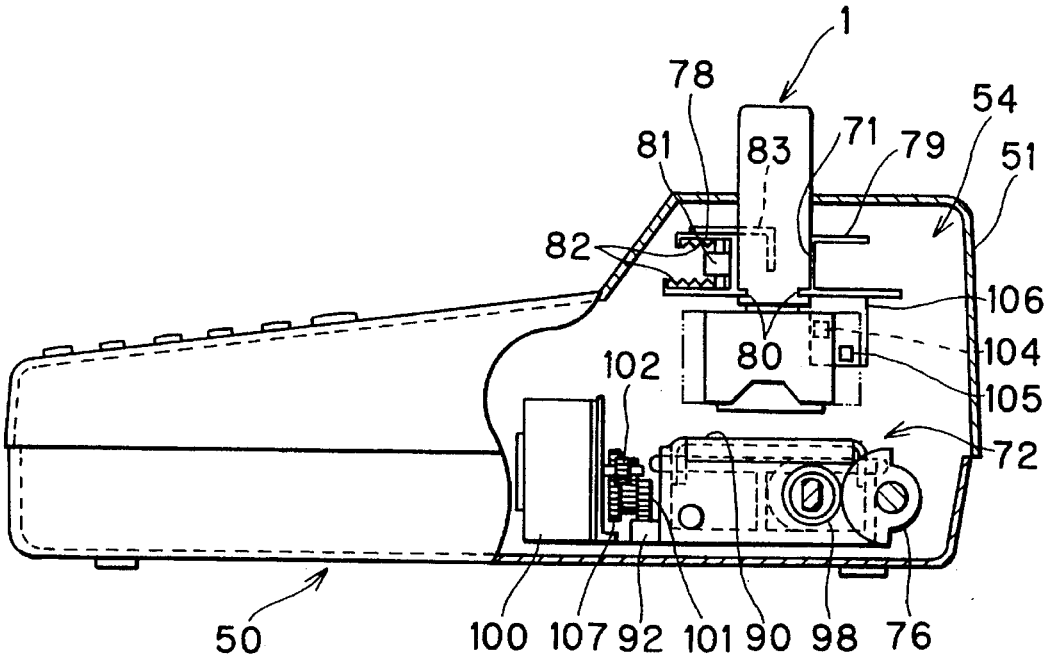
FIG. 17 is a side view of the thermal perforation device with a portion removed to facilitate explanation.
Figure 21:
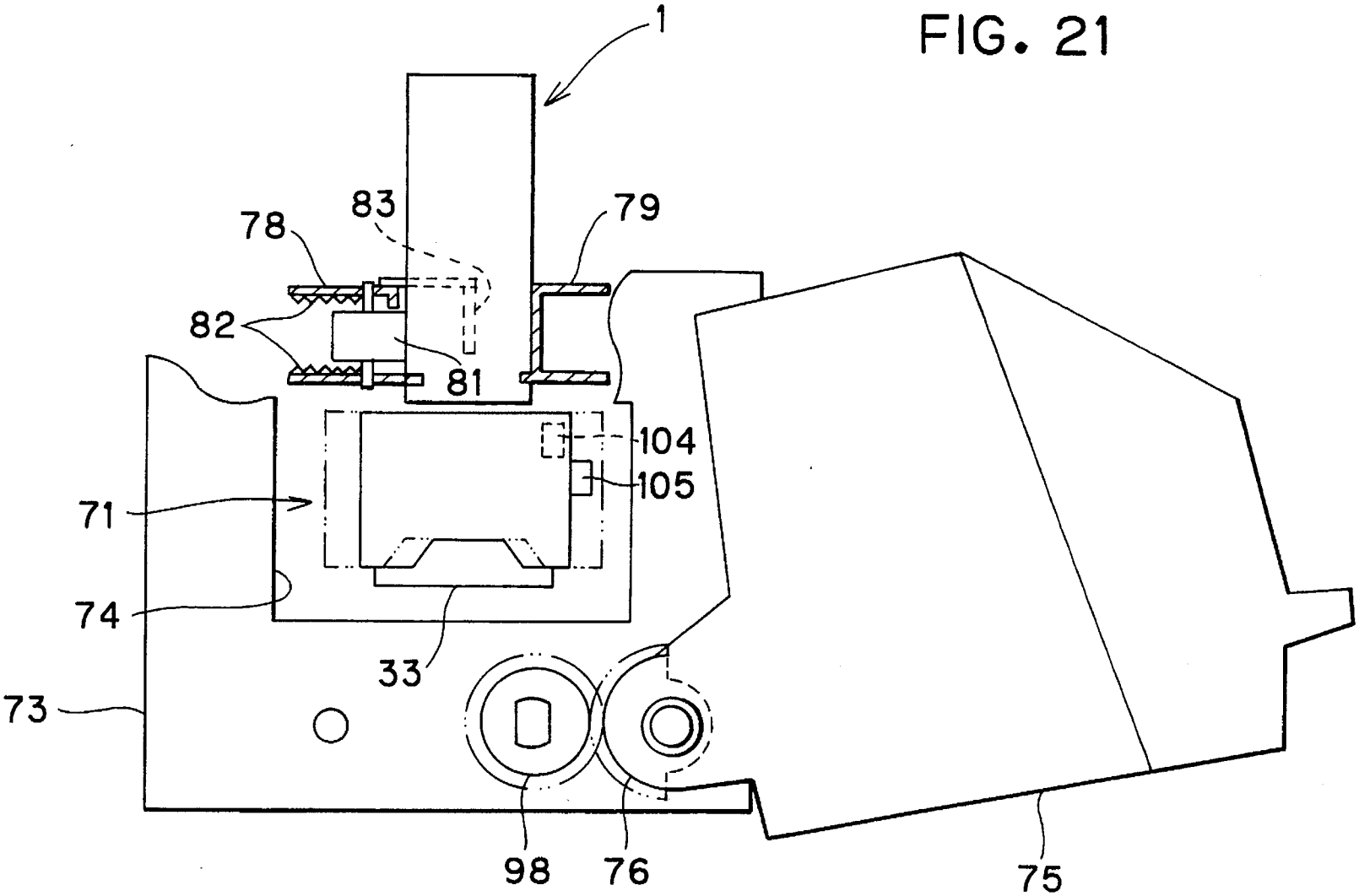
FIG. 21 is a side view showing principal components of the thermal perforation portion.

The thermal print device 50 of the present embodiment can be used to perforate patterns in the print face 33 of two types of stamp assembly 1. In FIGS. 17 and 21, a narrow-width type stamp assembly 1 is indicated by a solid line, and a wide-width type stamp assembly 1 is indicated by a chain line. As shown in FIGS. 15, 17, and 21, the two proximity switches 104 and 105 are provided to a plate 106 attached to the lower surface of the rear side guide member 79. The wide-width type of stamp assembly 1 is detected by the two proximity switches 104 and 105 and the narrow-width type of stamp assembly 1 is detected only by the proximity switch 104.

As shown in FIG. 24, the control unit 110 is provided with a CPU 111; a ROM 112; a RAM 113; a print CG-ROM 114; a display CG-ROM 115 for display on the display 53; an input interface 116 connected to the keyboard 52 and the proximity switches 104 and 105; and an output interface 117. These elements are connected to one another through a bus 118. The control unit 110 is further provided with a head driving circuit 119, a motor driving circuit 120, and a display driving circuit 121 which are connected to the output interface 117.

The ROM 112 is provided with a program memory 122 storing a control program for controlling the operator of the heat print device 50; and a dictionary memory 123 for Kana/Kanji conversion.

The RAM 113 is provided with an input buffer 124 for storing input data; a print data buffer 125 for storing print dot pattern data; a shift register 126; and various other counters and registers.

The print CG-ROM 114 contains dot pattern data of many character dots serving as a print target in correspondence with the code data. The display CG-ROM 115 stores display dot pattern data of many characters serving as a print target in correspondence with the code data.

Next the head drive circuit 119 will be explained. As shown in FIG. 25, each heat element 103 has two electrodes; one connected to a terminal 127 of a +12 V power source and one connected to the output terminal of a corresponding driver 128.

One input terminal of all the drivers 128 is connected to the output of an inserter 129, which is connected to a perforation strobe input terminal 130. The other input terminal of each driver 128 is connected to the output terminal of a corresponding latch circuit 132.

A latch signal input terminal 131 is connected to an input terminal of all the latch circuits 132. An output terminal of a corresponding one of a group of shift registers 135 is connected to the input terminal of a corresponding data latch circuit 132. A clock input terminal 133 and a data input terminal 143 are connected to input terminals of each shift resistor 135.

In the head drive circuit 119, perforation data is stored in the shift registers 135 in synchronization with the clock signal. When a latch signal is supplied to the data latch circuits 132, the data stored in the shift registers 135 is outputted to and stored in corresponding data latch circuits 132. Simultaneous with this, the data is applied to one input terminal of corresponding drivers 128. In this condition, application of a "0" logic perforation pulse signal from the perforation strobe input terminal 130 to the input terminal of the inserter 129 will result in a "1" logic signal being outputted from the output terminal of the inserter 129 and applied to the other input terminal of each driver 128.

Therefore, drivers 128 connected to data latch circuits 132 having "1" logic will develop "0" logic at their output terminals. Thermal elements 103 corresponding to these drivers 128 are energized by a drive current from the power source terminal 127. The width of the perforation pulse signal inputted to the perforation strobe input terminal 130 is set so that at this time the surface temperature of the thermal element 103 increases to a temperature suitable to melt a hole in the thermoplastic film 30.

Figure 26:
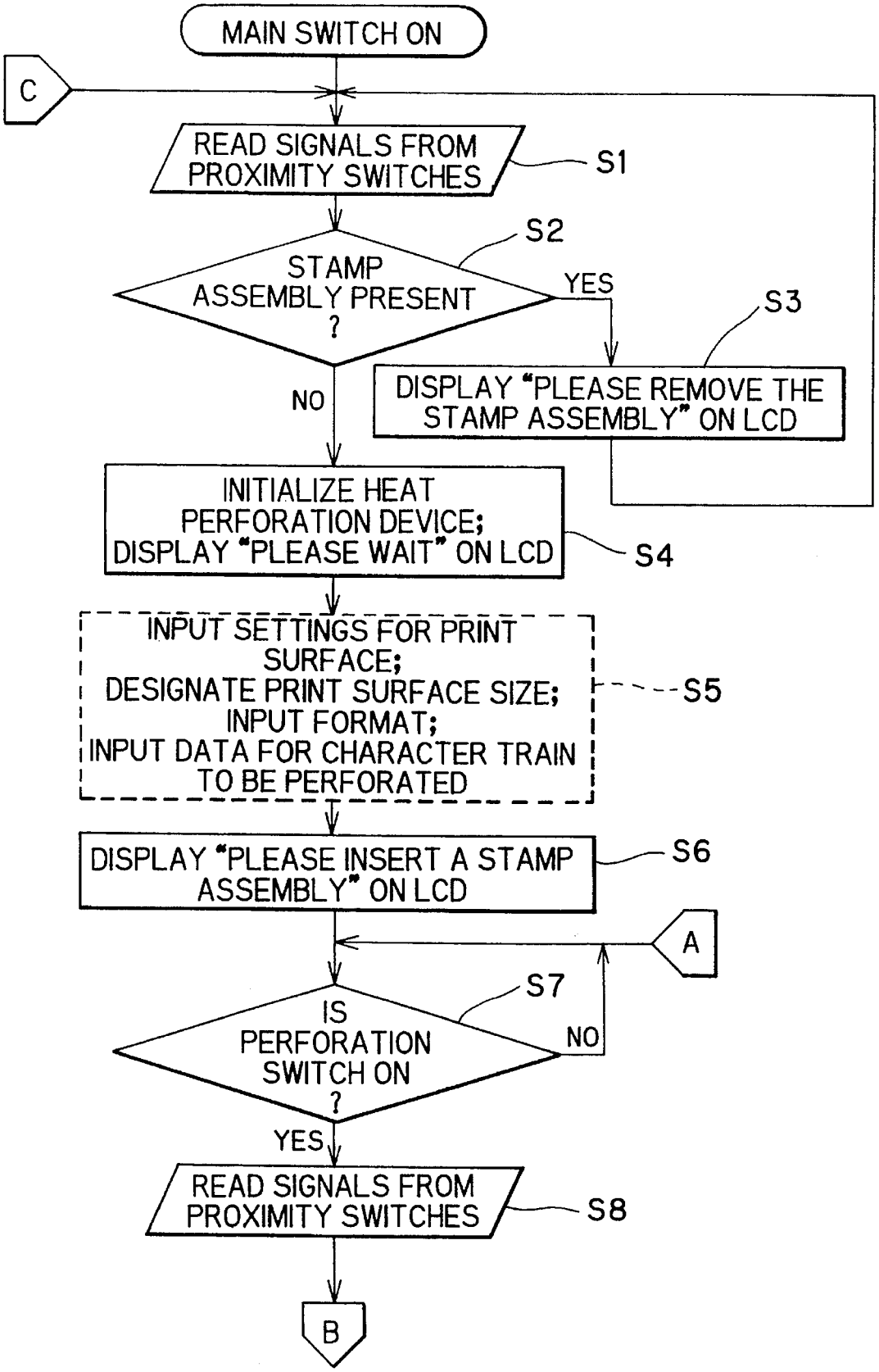
FIG. 26 is a flow chart representing a portion of perforation operations performed by the control system of the thermal perforation device.
Figure 27:
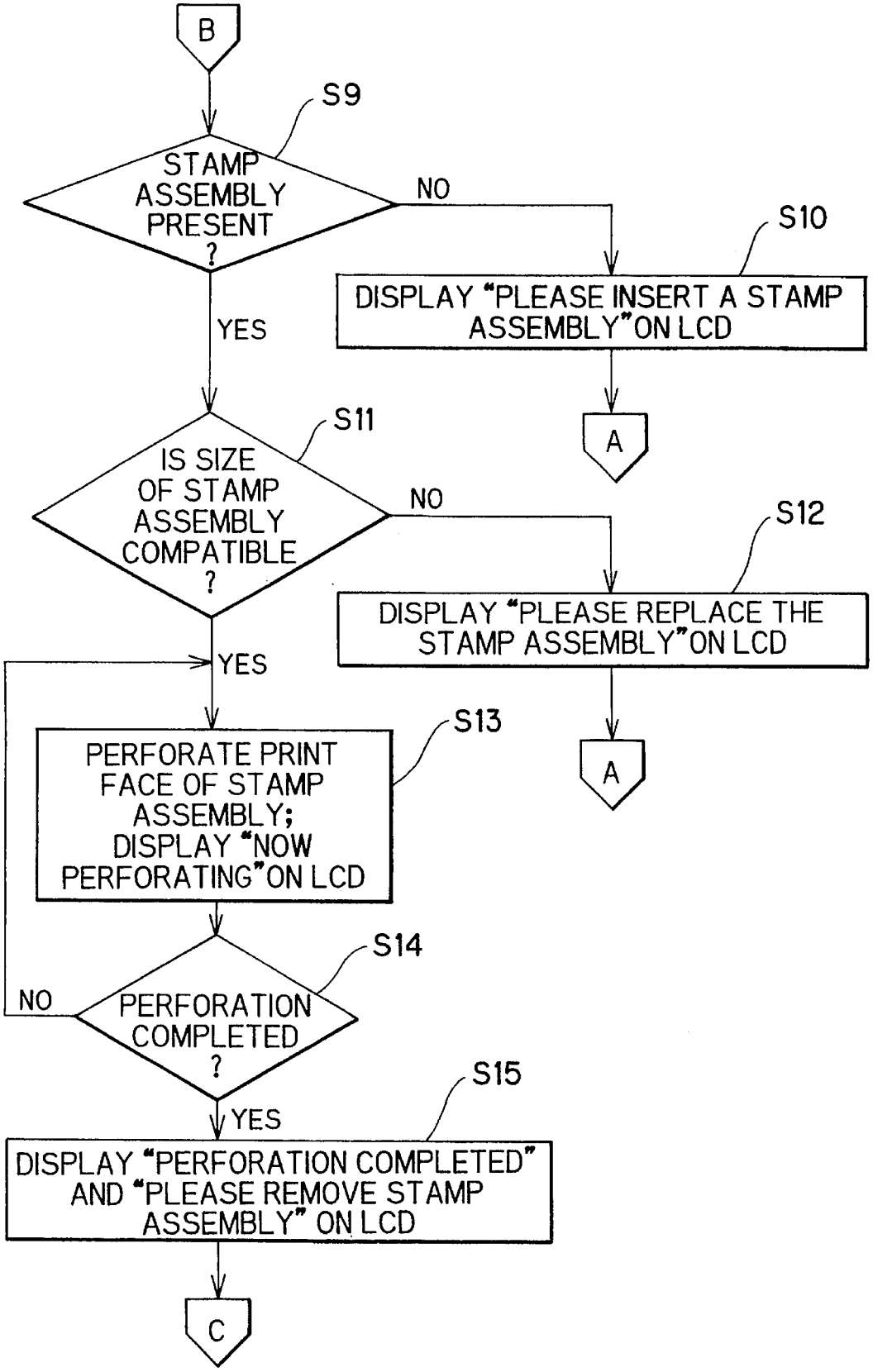
FIG. 27 is a flow chart representing other perforation operations of the thermal perforation device.

Next, processes using the heat perforation device 50 to perforate character train patterns in the print face 33 of the stamp assembly 1 will be explained with reference to the flow charts of FIGS. 26 and 27. In these Figs., the symbols Si (i=1, 2, 3 . . . ) show the processes executed by the control unit 110 and operations executed by the operator.

The program is started by switching on the main switch 67. First, a detection signal from the proximity switches 104 and 105 is received and read in step S1. Next, based on this, it is judged in step $2 whether or not the stamp assembly 1 is present, that is, whether or not the stamp assembly 1 is mounted on the perforation mount 71. If the judgment of step S2 is "Yes", that is, if the electric current was switched on while the stamp assembly 1 was mounted in the perforation mount 71, then the message "PLEASE REMOVE THE STAMP ASSEMBLY" is displayed in step S3 on the liquid crystal display (hereafter referred to as the LCD) 53, and the control program returns to step S1. Processes in steps S1 to S3 are repeated until the stamp assembly 1 is removed by the operator. When the opening-closing door 75 is opened and the stamp assembly 1 is removed, the judgment in step S2 becomes "No".

Initialization processes are executed if the stamp assembly 1 is not mounted on the perforation mount 71 when the current is switched on, or if the stamp assembly 1 is mounted on the perforation mount 71 when the current is switched on but the operator removes it so that the judgment in S2 becomes "No." Initialization processes include clearing data from the RAM 112 of the heat perforation device 50 and driving the stepping motor 100 to move the carriage 87 to the first stage position of the right end of the guide rod 88. During initialization processes the message "PLEASE WAIT" is displayed on the LCD 53 (S4). Next, in step S5, the operator operates the keyboard 52 to input settings for the print surface. Examples of settings for the print surface include the surface size of the print surface and the size and configuration of characters in the character train to be printed. In S5, the perforation character train data is also inputted to the input buffer 124.

Next, the message "PLEASE INSERT A STAMP ASSEMBLY" is displayed on the LCD 53 (S6), and the program remains in a stand-by condition until the perforation switch 66 is switched on (S7:No). Meanwhile, the operator opens the opening-closing door 75, inserts the stamp assembly 1, and then closes the opening-closing door 75, that is, the operator mounts the stamp assembly 1 to the perforation mount 71.

Opening the opening-closing door 75 rotates the sector gear 76 clockwise as viewed in FIG. 21. The gear 98 engaging the sector gear 76, and the head switching rod 89 passing through the gear 98, rotate counterclockwise, as viewed in FIG. 21, in association with clockwise rotation of the sector gear 76. As a result, the cam member 91 mounted to the head switching rod 89 is oriented into the reclining posture and the thermal head 91 is released downward together with the head heating plate 94.

The operator engages the guide 80 with the guide groove 15 on the grip 2 of the stamp assembly 1, and inserts the stamp assembly 1 through the opening 74. At this point, the thermal head 90 is shifted to one side and so does not obstruct the insertion of the stamp assembly 1. When the stamp assembly 1 is inserted into the opening 74, the guide bar 83 passes through guide holes 18 and 44 on the stamp assembly 1. As a result, the doorway-shaped portion 43 rises by following the tapered surface 84 of the guide bar 83. As shown in FIG. 21, the skirt member 6 rises along with the doorway-shaped portion 43 until its lower end is positioned above the print face 33. The skirt member 6 is maintained in this position as shown in FIG. 23.

When the operator inserts the stamp assembly 1 until it abuts the stop surface 85 of the guide bar 83, the stamp assembly 1 is located at a predetermined position within the perforation mount 71 as shown in FIG. 23.

Next, the operator closes the opening-closing door 75 by rotating it in the counterclockwise as viewed in FIG. 21. In association with this, the sector gear 76 rotates counterclockwise, as viewed in FIG. 19, so that the head switching rod 89 rotates clockwise, as viewed in FIG. 19 in association with rotation of the sector gear 76. As a result, the cam member 91 mounted to the head switching rod 89 is moved into the upright posture, which pivots the thermal head 90 upward, via the cam engaging plate 93 and the spring 97, into the perforation position where, as shown by the solid line shown in FIG. 23, the thermal head 90 is pressed onto the right end of the print face 33 of the stamp assembly 1.

After mounting the stamp assembly 1 as explained above, the operator turns the perforation switch 66 ON. When the perforation switch 66 is turned ON (S7:Yes), the detection signal of the proximity switches 104 and 105 is received and read in step S8. Based on this, whether or not the stamp assembly 1 is present, that is, whether or not the stamp assembly 1 is mounted to the perforation mount 71, is determined in step S9. If the judgment is "No", that is, if the operator has turned on the perforation switch 66 without inserting the stamp assembly 1, then the message "PLEASE INSERT A STAMP ASSEMBLY" is displayed on the LCD 53 in step S10. Then the program proceeds to step S7. However, if the stamp assembly 1 has been mounted so that the judgment in S9 is "Yes," and then whether or not the print face size determined in S5 and the stamp assembly 1 size are compatible is determined in step S11. The size of the stamp assembly 1 is the width of the stamp assembly 1 as determined based on the detection signal of the proximity switches 104 and 105.

Next, when the judgement in S11 is "No", that is, when the print face size determined in S5 and the stamp assembly 1 size are not compatible, then the message "PLEASE REPLACE THE STAMP ASSEMBLY" is displayed on the LCD 53, and the process proceeds to S7. Then, steps S7 to S12 are repeated until the stamp assembly 1 which is presently mounted is removed and replaced with one compatible with the determined print face size.

On the other hand, when the judgement in S11 is "Yes", that is, when the size of the mounted stamp assembly 1 is compatible with the determined print face size, then perforation printing is performed on the print face 33 of the stamp assembly 1, and the message "NOW PERFORATING" is displayed on the LCD 53 during the perforation printing. In the perforation printing operation, the perforation dot pattern data is generated based on the format inputted to the input buffer 124 and on the perforation character train data. The generated perforation dot pattern data is then stored in the perforation buffer 125. The stepping motor 100 is driven based on the perforation dot pattern data stored in the perforation buffer 125. As the carriage 87 travels from the position indicated by solid lines to those indicated by chain lines in FIG. 23, the thermal head 90 is driven and perforations are opened in the print face 33 based on the perforation dot pattern data.

The carriage 87 is driven to move leftward until the thermal head 90 separates from the print face 33. Therefore, the thermal head 90 is kept in pressing contact with the print face 33 until perforation is finished. This prevents ink from leaking through the print face 33. Next, whether or not perforation has been completed is determined in step S14. If perforation has been finished, in step S15, the messages "PERFORATION COMPLETED" and "PLEASE REMOVE STAMP ASSEMBLY" are displayed on the LCD 53. Then the program returns to S1. When the operator sees the message "PLEASE REMOVE STAMP ASSEMBLY," he or she opens the opening-closing door 75 and removes the stamp assembly 1. By this time, the carriage 87 has moved to the position indicated by the two chained lines in FIG. 23 so that neither the carriage 87 nor the thermal head 90 obstructs the removal of the stamp assembly 1.

If the stamp assembly 1 is not removed the operations in steps S1 to S3 are repeated until the stamp assembly is removed by the operator.

Once perforations have been formed in the stamp assembly 1, the operator slides the protector clasp 18*a* downward to close the guide hole 18 as shown in FIG. 1 (*a*) and FIG. 6 (*a*). As a result, even if an operator attempts to mount the stamp assembly 1 into the perforation device 50, because the guide hole 18 through which the guide bar 38 would pass is closed, duplicate perforating is prevented. When new perforations are to be formed, the operator slides the protector clasp 18*a* upward to open the guide hole 18, thereby allowing re-mounting of the thermal perforation device 50 as shown in FIG. 1 (*b*) and FIG. 6 (*b*).

Figure 12:
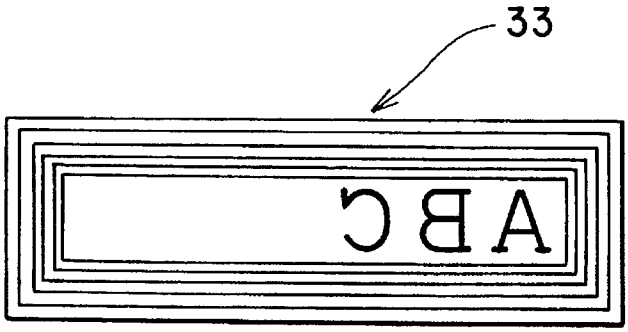
FIG. 12 is a view showing an example of a mirror-image character train perforated on the print face of the stamp member.
Figure 13:
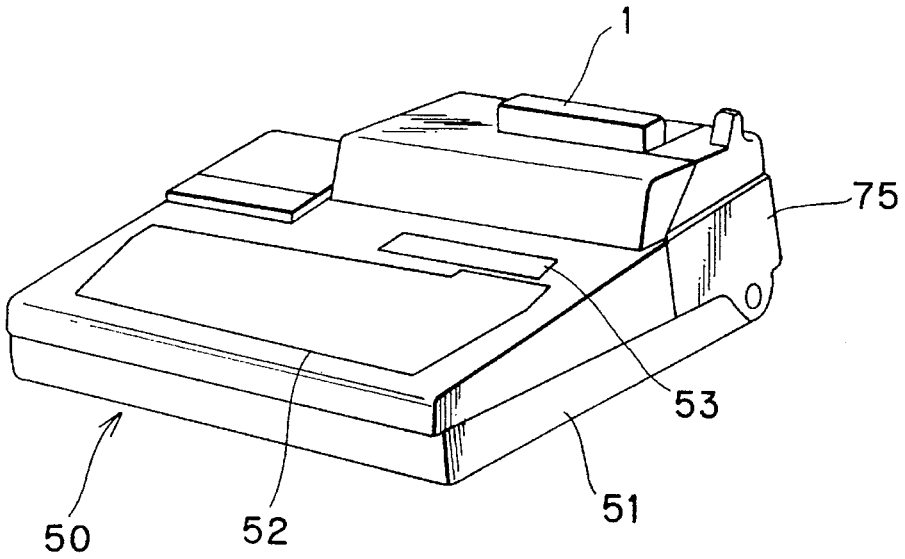
FIG. 13 is a perspective view of a thermal perforation device of the stamp unit.
Figure 14:
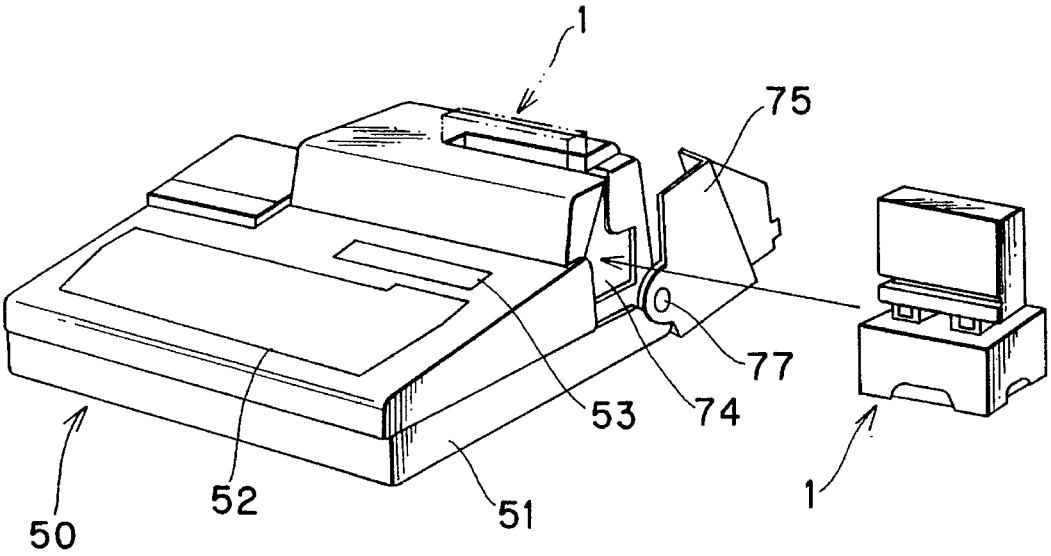
FIG. 14 is a perspective view of the stamp assembly and the thermal perforation device of the stamp unit.

The above operations open perforations to form the mirror image of a predetermined pattern in the heat-sensitive perforation paper 28, which serves as the print face 33 of the stamp assembly 1. The perforations can be opened using infrared irradiation instead of a thermal head. An example of a mirror image is shown in FIG. 12, wherein a character train for "ABC" is surrounded by six concentric rectangular frames. The resultant stamp assembly 1 is capable of printing the character train "ABC," which is in mirror image as shown in FIG. 12, and the six concentric rectangular frames in the same manner as an ordinary stamp having a print face formed of rubber and can be used to print the image approximately 1,000 times, for example.

While the stamp assembly is unused, the print face 33 of the stamp assembly 1 is protected by the protector cap 7 as shown in FIGS. 3 and 4 and the skirt member 6 is maintained in the first position. To print using the stamp assembly 1, the protection cap 7 is detached and the skirt member 6 is held in the first position while used to position the stamp face 33 to a position on the surface of a sheet where printing is to be performed. After the print face 33 of the stamp member 3 is in position, the grip 2 is grasped and pressed downwards to print in the manner shown in FIG. 11. When the print face 33 is pressed onto the surface of the sheet, the ink inside the impregnated member 27 seeps through the various perforations, thereby printing the perforation pattern on the surface of the sheet.

While the invention has been described in detail with reference to specific embodiments thereof, it would be apparent to those skilled in the art that various changes and modifications may be made therein without departing from the spirit of the invention, the scope of which is defined by the attached claims.

For example, patterns perforated on the heat-sensitive perforation paper 28 of the print face 33 are not limited to the example explained above. Many other perforation dot patterns can be formed to print a variety of character trains, diagrams, marks and patterns for a wide range of uses.

The grip 2 and the stamp member 3 can be shortened and formed into an integral unit. Further, the skirt member 6 can be mounted so as to move freely upwards and downwards in relation to the stamp frame 4.

The grip 2 need not be fixed to the top of the stamp frame 4 but can be fixed to the side of the stamp frame 4.

If the print surface 33 is, for example, rectangular in shape, the skirt member 6 will perform all necessary functions as long legs are provided to its four corners.

The print face 33 of the stamp assembly 1 need not have a rectangular shape, but could have a variety of shapes such as oval, circular, square, triangular, and polygonal shapes.

Many colors, such as blue, black, and red, are suitable for the color of the oil-based ink impregnated in the impregnated member 27. In order to indicate the color of the ink on the label 10, a sheet actually printed in the stamp assembly 1 can be pasted in the recess 11 provided on the top end of the grip 2.

An ink member formed from a mass of high viscosity ink can be used instead of the impregnated member 27. This ink member can be mounted in the recess 25 so that it achieves the same shape as the impregnated member 27.

The perforation mount 71 was described constructed so that the stamp assembly 1 could be freely detachably mounted from its right side, but it can also be constructed so that the stamp assembly 1 could be mounted from above.

The thermal perforation mechanism 72 was described as constructed so as to form perforations by moving the carriage 87 to transport the thermal head 90 while maintaining the stamp assembly 1 in a predetermined position, but perforation can also be achieved by moving the stamp assembly 1 across a thermal head 90 fixed to the thermal perforation mechanism 72.

A solenoid actuator can be fitted instead of the cam member 91 to switch the position of the thermal head 90.

Instead of the rack 92, the drive gear 101, and the decelerating gear mechanism 107, the carriage 87 can moved in the left and right direction by means of a wire and pulley.

Instead of the guide hole 44, a guide hole with a sloping taper face can be provided as an upper wall to the doorway-shaped portion 43 of the stamp assembly 1. In this case, the taper face 84 not need to be provided to the guide bar 83. When the stamp assembly 1 is mounted on the perforation mount 71 and the guide bar 83 passes through the guide holes of the stamp assembly 1, the taper face at the upper wall of the guide holes 44 will abut and run against the guide bar 83 so that the doorway-shaped portion 43 rises up. The skirt member 6 will also rise in association with the rise of the doorway-shaped portion 43.

As is clear from the above explanation, because the stamp unit of the present invention is provided with an opening-closing means to open and close the guide hole, once operations for forming perforations have be performed, the guide hole is closed by the opening-closing means, thus preventing duplicated perforating.

What is claimed is:

1. A stamp assembly mountable to a thermal perforation unit for forming perforations in heat-sensitive stencil sheet, the thermal perforation unit having a mounting member for mounting the stamp assembly to the thermal perforation unit, the stamp assembly comprising:

a mounting member reception portion formed with a guide hole through which the mounting member is inserted to mount the stamp assembly to the thermal perforation unit;

a stencil plate fixed to said mounting member reception portion, said stencil plate including an ink-impregnated member and a heat-sensitive stencil sheet; and an opening-closing means for opening and closing the guide hole.

2. A stamp assembly as claimed in claim 1 wherein the opening-closing means includes a lid which can be manually slid between an open position wherein the guide hole is open and a closed position wherein the guide hole is closed.

3. A stamp assembly as claimed in claim 2 further comprising a maintenance means disposed between the mounting member reception portion and the lid, the maintenance means being for maintaining the lid in the open position and in the closed position.

4. A stamp assembly as claimed in claim 3 wherein said maintenance means includes an elastic slat having a protruding tip extending into the guide hole; and two elastic ridges formed on a surface of said lid, the two elastic ridges extending parallel with each other in a direction perpendicular to a sliding direction of said lid, one of the two elastic ridges engaging with the protruding tip when the lid is in the closed position and another of the two elastic ridges engaging with the protruding tip when the lid is in the open position.

5. A stamp assembly as claimed in claim 4 wherein the protruding tip has an upper surface and a lower surface, the one of the two ridges has an upper surface which abuts against the lower surface of the protruding tip in the closed position, and the another of the two ridges has a lower surface which abuts against the upper surface of the protruding tip in the open position.

6. A stamp assembly as claimed in claim 2 wherein the mounting member reception portion is provided with a guide wall extending along the guide hole, the guide wall having an inner side and an outer side; and wherein the lid is provided with an elastic engagement slat which deforms, passes around the guide wall, and engages with the inner side of the guide wall when pressed against the outer side of the guide wall.

7. A stamp assembly as claimed in claim 2 wherein the mounting member reception portion includes a grip for an operator to manually grasp while printing stamps with the stamp assembly.

8. A stamp unit comprising:

a stamp assembly having a mounting member reception portion, the mounting member reception portion formed with a guide hole;

a stencil plate fixed to said stamp assembly, said stencil plate including an ink-impregnated member and a heat-sensitive stencil sheet;

a thermal perforation unit for forming perforations in the heat-sensitive stencil sheet;

a member for passing through the guide hole to position said stamp assembly at a position where said thermal perforation unit can form perforations in the heat-sensitive stencil sheet; and an opening-closing means for opening and closing the guide hole.

9. A stamp unit as claimed in claim 8 wherein the opening-closing means includes a lid which can be manually slid between an open position wherein the guide hole is open and a closed position wherein the guide hole is closed.

10. A stamp unit as claimed in claim 9 further comprising a maintenance means disposed between the mounting member reception portion and the lid, the maintenance means being for maintaining the lid in the open position and in the closed position.

11. A stamp unit as claimed in claim 10 wherein said maintenance means includes an elastic slat having a protruding tip extending into the guide hole; and two elastic ridges formed on a surface of said lid, the two elastic ridges extending parallel with each other in a direction perpendicular to a sliding direction of said lid, one of the two elastic ridges engaging with the protruding tip when the lid is in the closed position and another of the two elastic ridges engaging with the protruding tip when the lid is in the open position.

12. A stamp unit as claimed in claim 11 wherein the protruding tip has an upper surface and a lower surface, the one of the two ridges has an upper surface which abuts against the lower surface of the protruding tip in the closed position, and the another of the two ridges has a lower surface which abuts against the upper surface of the protruding tip in the open position.

13. A stamp unit as claimed in claim 9 wherein the mounting member reception portion is provided with a guide wall extending along the guide hole, the guide wall having an inner side and an outer side; and wherein the lid is provided with an elastic engagement slat which deforms, passes around the guide wall, and engages with the inner side of the guide wall when pressed against the outer side of the guide wall.

14. A stamp unit as claimed in claim 9 wherein the mounting member reception portion includes a grip for an operator to manually grasp while printing stamps with the stamp assembly.

* * * * *